US007728860B2

(12) United States Patent
Kawahara et al.

(10) Patent No.: US 7,728,860 B2
(45) **Date of Patent: *Jun. 1, 2010**

(54) METHOD FOR IMAGE PROCESSING AND IMAGE PROCESSING APPARATUS

(75) Inventors: Shinya Kawahara, Numazu (JP); Yoshihiko Hotta, Mishima (JP); Satoshi Arai, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 424 days.

This patent is subject to a terminal disclaimer.

(21) Appl. No.: 11/502,853

(22) Filed: Aug. 10, 2006

(65) Prior Publication Data

US 2007/0036039 A1 Feb. 15, 2007

(30) Foreign Application Priority Data

Aug. 12, 2005 (JP) ..... 2005-234439

(51) Int. Cl.
*B41J 2/435* (2006.01)

(52) U.S. Cl. ..... 347/224

(58) Field of Classification Search ..... 347/139, 347/179, 224; 503/201; 36/112.28; 428/64.1
See application file for complete search history.

(56) References Cited

U.S. PATENT DOCUMENTS 4,811,328 A * 3/1989 Ito et al. ..... 369/112.28
5,619,243 A * 4/1997 Hotta et al. ..... 347/139
6,129,968 A * 10/2000 Ogawa ..... 428/64.1
6,818,591 B2 * 11/2004 Arai et al. ..... 503/201
7,049,268 B2 * 5/2006 Sakata et al. ..... 503/201
7,439,993 B2 * 10/2008 Ishimi et al. ..... 347/179

(Continued)

FOREIGN PATENT DOCUMENTS

EP 1277593 A2 1/2003

(Continued)

OTHER PUBLICATIONS

European Search Report in connection with European application EP 06 01 6836.

(Continued)

*Primary Examiner*—Hai C Pham
(74) *Attorney, Agent, or Firm*—Cooper & Dunham LLP

(57) ABSTRACT

It is an object of the present invention to provide a method for image processing and an image processing apparatus which are capable of performing repetitive forming and erasing of high-contrast images at high speeds by forming high-density, uniform images and uniformly erasing images in a short period of time, and in addition, suppressing the degradation of the thermoreversible recording medium due to repetitive forming and erasing is possible. The method for image processing of the present invention contains at least any one of image forming step wherein an image is formed on a thermoreversible recording medium in which any one of transparency and color tone is changed reversibly depending on temperatures by heating due to laser beam irradiation, and image erasing step wherein an image formed on the thermoreversible recording medium is erased by heating due to laser beam irradiation to the thermoreversible recording medium, and a light irradiation intensity of the center is equal to or less than the light irradiation intensity of the periphery in the light intensity distribution of cross-section in a direction approximately perpendicular to the traveling direction of the laser beam irradiated at least in any one of the image forming step and the image erasing step.

20 Claims, 13 Drawing Sheets

U.S. PATENT DOCUMENTS

| | | | | |
|---|---|---|---|---|
| 2003/0114304 | A1 | 6/2003 | Arai et al. | |
| 2004/0116289 | A1 | 6/2004 | Tsukida et al. | |
| 2007/0285488 | A1 * | 12/2007 | Ishimi et al. | 347/179 |

FOREIGN PATENT DOCUMENTS

| | | | | |
|---|---|---|---|---|
| EP | 1431058 | A2 | | 6/2004 |
| JP | 63-20742 | | | 1/1988 |
| JP | 2-53236 | | | 2/1990 |
| JP | 4-250074 | | | 9/1992 |
| JP | 07186445 | A | * | 7/1995 |
| JP | 8-258423 | | | 10/1996 |
| JP | 10-114090 | | | 5/1998 |
| JP | 10-217523 | | | 8/1998 |
| JP | 11-105317 | | | 4/1999 |
| JP | 2000-136022 | | | 5/2000 |
| JP | 2001-71543 | | | 3/2001 |
| JP | 3350836 | | | 9/2002 |
| JP | 2002-347272 | | | 12/2002 |
| JP | 2003-127446 | | | 5/2003 |
| JP | 3446316 | | | 7/2003 |
| JP | 2003-246144 | | | 9/2003 |
| JP | 2003-285415 | | | 10/2003 |
| JP | 3493482 | | | 11/2003 |
| JP | 2004-1264 | | | 1/2004 |
| JP | 2004-58660 | | | 2/2004 |
| JP | 2004-195751 | | | 7/2004 |
| JP | 2004-265247 | | | 9/2004 |
| JP | 2004-265249 | | | 9/2004 |
| JP | 2004-322492 | | | 11/2004 |
| JP | 2004-345273 | | | 12/2004 |
| JP | 2004345273 | A | * | 12/2004 |

OTHER PUBLICATIONS

European Search Report in connection with European application EP 06 01 6836, (issued in Jan. 8, 2007).

* cited by examiner

METHOD FOR IMAGE PROCESSING AND IMAGE PROCESSING APPARATUS

BACKGROUND OF THE INVENTION

1. Technical Field

This disclosure relates to a method for image processing on thermoreversible recording media and an image processing apparatus, specifically, a method for image processing capable of repetitive forming and erasing of high-contrast images at high speeds by forming high-density, uniform images and uniformly erasing images in a short period of time, and an image processing apparatus which can be suitably used for the method for image processing.

2. Description of the Related Art

Until now, forming and erasing of images on thermoreversible recording media (hereinafter may be referred to as "recording media" or "media") are performed by contact methods in which the media are heated by contact with heat sources. Generally, thermal heads are used for forming images and heat roller and ceramic heater, etc. are used for erasing images.

Such methods for recording by contact are advantageous in being able to perform uniform forming and erasing of images by uniformly pressing the media to heat sources using platen, etc. if recording media are flexible materials such as films or paper, and making possible to manufacture image forming apparatus and image erasing apparatus inexpensively by using existing printer parts for thermosensitive paper.

However, if the recording media has a built-in RF-ID tag as described in Japanese Patent Application Laid-Open (JP-A) Nos. 2004-265247 and 2004-265249, the media becomes thick, flexibility is reduced and high pressure is needed in order to press heat sources uniformly. Moreover, if irregularity occurs on the surfaces of media, it becomes difficult to form and erase images using thermal heads, etc. Furthermore, because reading and overwriting of memory information are performed on RF-ID tag from some distance without contact, demand for performing overwriting of images from some distance has also appeared for the thermoreversible recording media.

With that, a method using a laser may possibly be used when irregularity occurred on the surfaces of media, or as a method for forming and erasing images on recording media from some distance.

Typical examples of related art which performs recording and erasing some patterns using lasers include optical discs such as CD-RW and DVD-RW, etc. On these discs, patterns as memory information are formed by the difference in optical reflectivity caused by the changes between crystalline state and amorphous state in inorganic materials such as Te, Se, In, Ag, etc. The change between crystalline state and amorphous state is caused by the difference in cooling rate after material has been melted by laser irradiation.

On the other hand, the thermoreversible recording media exhibit changes between color developing and color erasing by the difference in heating temperatures at which the media have been heated. In other words, it is necessary for the materials to be heated to their melting temperatures in a similar manner for both image forming and image erasing and patterns are formed by controlling subsequent cooling rate on the above optical discs. For the thermoreversible recording media, image forming and erasing are determined by the temperatures attained by the media due to heating by laser irradiation instead of subsequent cooling rate. Thus, processes and mechanisms of the optical discs and thermoreversible recording media completely differ from each other although same lasers are irradiated to form and erase some patterns.

Even though the difference in optical reflectivities between crystalline state and non-crystalline state of optical discs may be satisfactory for electrically detecting the difference in reflectivities by laser irradiation, the difference has been as such that it is faintly visible with eyes and is quite inadequate.

A method using lasers for forming and erasing images on recording media from some distance or when irregularity occurred on the surfaces of thermoreversible recording media is stated in JP-A No. 2000-136022, for example. It is the method by which non-contact recording is performed by using thermoreversible recording media on shipping containers used for physical distribution lines, and it is disclosed that writing is performed by using lasers and erasing is performed by using hot air, heated water, infrared heater, etc.

Methods for printing and recording using lasers are disclosed in Japanese Patent (JP-B) Nos. 3350836, 3446316, JP-A Nos. 2002-347272 and 2004-195751, for example.

The technique disclosed in JP-B No. 3350836 is an improved method for image forming and erasing which includes performing any one of forming and erasing of images on thermoreversible recording media by the heat generated from the laser beam irradiated to a photothermal conversion sheet after the photothermal conversion sheet is placed on the thermoreversible recording media. And it is disclosed in the literature that it is possible to perform both of forming and erasing of images by controlling irradiation condition of laser beams. In other words, it is stated that it is possible to control heating temperatures to a first specified temperature and a second specified temperature of the thermoreversible recording media by controlling at least one of light irradiation time, irradiated light intensity, focus and light intensity distribution or to perform forming and erasing of images entirely or partially by changing cooling rates after heating.

A method using two laser beams, in which erasing is performed by using one of the beams as oval or oblong laser, and recording is performed by using the other beam as circular laser, a method for recording using a composition of two lasers, and a method for recording using each composition of transformed two lasers are stated in JP-B No. 3446316. By these methods using two lasers, image recording of higher density than the recording using one laser can be realized.

Moreover, a technique disclosed in JP-A No. 2002-347272 in which beam shapes of laser beams are changed by optical path difference or the difference in mirror shapes by using both sides of one mirror during laser recording and erasing. By this method, it is possible to change size of light spots or to defocus by means of simple optical systems.

Furthermore, it is disclosed in JP-A No. 2004-195751 that residual images after erasing can be completely erased practically by setting a laser absorption rate of reversible thermosensitive recording media in label form to 50% or more, an irradiation energy during printing to 5.0 mJ/mm$^2$ to 15.0 mJ/mm$^2$, a product of laser absorption rate and printing irradiation energy to 3.0 mJ/mm$^2$ to 14.0 mJ/mm$^2$ and a product of laser absorption rate during erasing and printing irradiation energy to 1.1 times to 3.0 times.

In contrast, a method for erasing using lasers in which recording of clear-contrast images of high durability on reversible thermosensitive recording media is realized by erasing with laser beam energy, irradiation time of the laser beam and scan speed for pulse width which are set at 25% or more and 65% or less of those of laser recording is proposed in JP-A No. 2003-246144.

Although laser printing and erasing can be performed by the method as described above, because laser control is not operated during printing, a problem such that local heat damages occur in the places where lines are overlapped with each other or a problem of reduction in color developing density when solid images are being recorded arises during recording.

In order to settle above issues, a method for controlling printing energy is disclosed in JP-A Nos. 2003-127446 and 2004-345273.

It is stated in JP-A No. 2003-127446 that the local heat damages are reduced to prevent degradation of reversible thermosensitive recording media by lowering the energy added to the area where laser irradiation energy is controlled every draw dots to print overlapped recording dots or to print by turning back or by lowering the energy at specified intervals for printing straight.

Moreover, in JP-A No. 2004-345273, irradiation energy is multiplied by the next equation, $|\cos 0.5R|^k (0.3<k<4)$ corresponding to angle R of bending point during laser drawing to reduce energy. By doing this, it becomes possible to prevent excessive energy from being added to the overlapped area of lineal drawing during laser recording to be able to reduce degradation of media, or to maintain contrast without lowering the energy too much.

Also, a method for preventing degradation of color developing density in which pitch of dot alignments in vertical scanning is set two times or more of beam diameter for color developing to make it equal to or less than the sum of diameter for color erasing and beam diameter for color developing to eliminate degradation of color developing density and occurrence of erasing marks in order to prevent erasing of images which has been recorded when overwriting is performed by lasers is proposed in JP-A No. 2004-1264.

As described above, efforts are made to prevent excessive energy from being added to thermoreversible recording media by overlapping during laser recording in the methods described as above. However, if high-density printing and uniform erasing are performed repeatedly using high-output laser, not only overlapping occurs in the area of laser drawing but phenomenon of gradually degrading thermoreversible recording media occurs even in the area of straight-line images. This is because energy distribution of irradiated laser beam becomes Gaussian distribution and energy in the center is increased excessively. The center of recorded linear image is heated excessively, deformation marks of thermoreversible recording media or generation of air bubbles are observed, and material itself, which bears color developing and color erasing properties, is thermally decomposed in the area corresponding to the center of the laser beam which is heated to high temperatures, thereby preventing satisfactory performance to be exhibited. Therefore, high-density and uniform image forming and uniform image erasing are not performed sufficiently and it is unsatisfactory as a method for recording images which is hardly degraded even when erasing/printing are performed repeatedly.

Furthermore, when thermoreversible recording media are combined with above-mentioned RF-ID tag, or pasted to bulk containers or holders, irregularity occurs on the media surfaces, making focus point of lasers inconstant, and when excessive energy is added to the thermoreversible media or even when an energy for performing erasing is added, the temperature of the media may be raised to the color developing temperature, or contrary, remainder may occur due to insufficient erasing.

Moreover, a method for recording lot numbers or model numbers directly on metals or plastics so-called laser marker is known even though it is not capable of overwriting. The laser marker forms images by melting or decomposing metals or plastics with laser energy to scratch or leave marks on the surfaces of metals and plastics. For the above method, it is necessary to focus laser and to increase the energy in the center of laser irradiation.

However, when images are formed on thermoreversible recording media, in which transparency or color tone is reversely changed by heat, by focusing laser as similar to normal laser marker, the temperature in the center of laser irradiation is increased too much, and when forming and erasing of images are repeated, the repeated area is degraded, thereby decreasing repeated numbers. And when laser irradiation energy is reduced so as not to increase the temperature of the center, size of images is reduced resulting in degradation of image contrast or prolonged time for image forming.

BRIEF SUMMARY

There is provided in this disclosure a method for image processing capable of repetitive forming and erasing of high-contrast images on thermoreversible recording media at high speeds by forming high-density, uniform images and uniformly erasing images in a short period of time, in which degradation of the thermoreversible recording media caused by repetitive forming and erasing is suppressed, and an image processing apparatus suitably used for the method for image processing.

The first aspect of the method for image processing of the present invention contains at least any one of image forming step wherein an image is formed on a thermoreversible recording medium by heating due to laser beam irradiation to the thermoreversible recording medium and image erasing step wherein an image formed on the thermoreversible recording medium is erased by heating and a light irradiation intensity of the center is equal to or less than the light irradiation intensity of the periphery in the light intensity distribution of cross-section in a direction approximately perpendicular to the traveling direction of the laser beam irradiated at least in any one of the image forming step and the image erasing step.

In the method for image processing, a laser beam in which the light irradiation intensity of the center is equal to or less than the light irradiation intensity of the periphery in the light intensity distribution is irradiated to the thermoreversible recording medium at least in any one of the image forming step and the image erasing step. Because of this, unlike in the case of using an existing laser beam of Gaussian distribution, degradation of the thermoreversible recording medium caused by repetitive forming and erasing of images is suppressed and high-contrast images are formed without reducing the image size.

The second aspect of the method for image processing of the present invention contains at least any one of image forming step and image erasing step, wherein the image erasing step contains erasing an image in a second image erasing area which is adjacent to a first image erasing area after erasing an image in the first image erasing are by scanning the laser beam, and the distance between the irradiation position of the laser beam and the first image erasing area and the irradiation position of the laser beam and the second image erasing area is 1/12 to 1/4 of the irradiation spot diameter of the laser beam.

In the image erasing step of the method for image processing, a laser beam is irradiated in a way so that the distance between the irradiation position of the laser beam and the first image erasing area and the irradiation position of the laser beam and the second image erasing area is 1/12 to 1/4 of the irradiation spot diameter of the laser beam for erasing the image located in the first image erasing area and the second image erasing area which are adjacent to each other in the thermoreversible recording medium. As a result, images formed on the thermoreversible recording medium are erased uniformly in a short period of time.

The third aspect of the method for image processing of the present invention contains at least any one of image forming step wherein an image is formed on a thermoreversible recording medium, which contains at least a resin and an organic low-molecular material and any one of transparency and color tone is changed reversibly depending on temperatures and image erasing step wherein an image formed on the thermoreversible recording medium is erased, and the image forming step contains forming an image in a second image forming area which is adjacent to a first image forming area after forming an image in the first image forming area by scanning the laser beam, and the laser beam is irradiated to the second image forming area so as to be overlapped with part of the first image forming area after the organic low-molecular material found in the first image forming area is melted prior to crystallization.

In the image forming step of the method for image processing, the laser beam is irradiated to the second image forming area so as to be overlapped with part of the first image forming area after the organic low-molecular material found in the first image forming area is melted prior to crystallization. As a result, the image formed in the first image forming area is not erased in the overlapped area (boundary portion) of the laser beam irradiation area in the first image forming area and the laser beam irradiation area in the second image forming area, and high-contrast, uniform and appropriate images are obtained.

The image processing apparatus of the present invention is used for the method for image processing of the present invention and contains at least a laser beam irradiation unit and a laser beam intensity adjusting unit placed on a surface of the laser beam irradiation unit from which a laser beam is irradiated and configured to change the light irradiation intensity of the laser beam.

In the image processing apparatus, a laser beam is irradiated from the laser beam irradiation unit. The light irradiation intensity of the laser beam irradiated from the laser beam irradiation unit is changed by the light irradiation intensity adjusting unit. As a result, the light irradiation intensity of the center becomes equivalent to or less than the light irradiation intensity of the periphery in the light intensity distribution of cross-section in a direction approximately perpendicular to the traveling direction of the laser beam. When an image is formed on the thermoreversible recording medium by using the laser beam of which the light irradiation intensity is adjusted as above, degradation of the thermoreversible recording medium caused by repetitive forming and erasing of images can be suppressed effectively.

DESCRIPTION OF THE PREFERRED EMBODIMENTS

Method for Image Processing

Figure 1A:
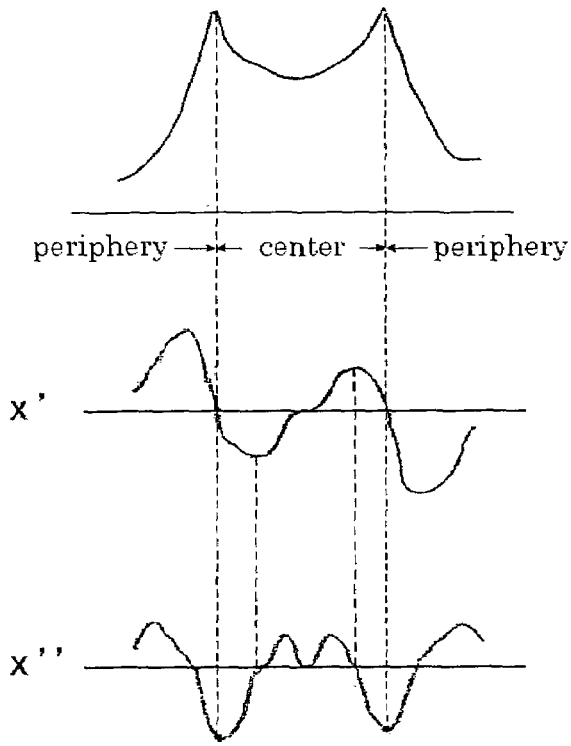
FIG. 1A is a schematic diagram showing an exemplary light irradiation intensity of the "center" and the "periphery" in the light intensity distribution of orthogonal cross-section to a traveling direction of the laser beam used in the method for image processing of the present invention.

The method for image processing of the present invention includes at least any one of image forming step and image erasing step, and further includes other steps as necessary.

The method for image processing of the present invention includes any one of an aspect in which both of forming and erasing of images are performed, an aspect in which only forming of images is performed, and an aspect in which only erasing of images is performed.

<Image Forming Step and Image Erasing Step>

The image forming step in the method for image processing of the present invention is a step which forms an image on a thermoreversible recording medium, in which any one of transparency and color tone is changed reversely depending on temperatures, by heating the thermoreversible recording medium through laser beam irradiation.

The image erasing step in the method for image processing of the present invention is a step which erases an image formed on the thermoreversible recording medium by heating the thermoreversible recording medium through laser beam irradiation.

It is possible to perform forming and erasing of images without touching the thermoreversible recording medium by heating through laser beam irradiation.

In the method for image processing of the present invention in general, image update (the image erasing step) is first performed when the thermoreversible recording medium is reused and images are then formed in the image forming step. However, the order of forming and erasing of images is not limited to the above, and images may be erased in the image erasing step after the images are formed in the image forming step.

In the first aspect of the method for image processing of the present invention, the light irradiation intensity of the center is equal to or less than the light irradiation intensity of the periphery in the light intensity distribution of cross-section in a direction approximately perpendicular to the traveling direction of the laser beam which is irradiated at least in any one of the image forming step and the image erasing step.

Moreover, in the second aspect of the method for image processing of the present invention, the image erasing step includes image erasing in the second image erasing area which is adjacent to the first image erasing area after images are erased in the first image erasing area by scanning the laser beam, and the distance between the laser beam irradiation position and the first image erasing area, and the laser beam irradiation position and the second image erasing area is 1/12 to 1/4 of the irradiation spot diameter of the laser beam.

Furthermore, in the third aspect of the method for image processing of the present invention, the thermoreversible recording medium contains at least a resin and an organic low-molecular material, and the image forming step includes image forming in the second image forming area which is adjacent to the first image forming area after images are formed in the first image forming area by scanning the laser beam. And the laser beam is irradiated to the second image forming area so as to be overlapped with part of the first image forming area after organic low-molecular material, which is found in the first image forming area, is melted prior to crystallization.

—First Aspect—

In the first aspect of the method for image processing of the present invention, a laser beam is irradiated to the thermoreversible recording medium in a way so that the light irradiation intensity of the center is equal to or less than the light irradiation intensity of the periphery in the light intensity distribution of cross-section in a direction approximately perpendicular to the traveling direction of the laser beam (hereinafter, may be referred to as "orthogonal cross-section to a traveling direction of the laser beam") which is irradiated at least in any one of the image forming step and the image erasing step.

When some sort of patterns are formed by using a laser in general, light intensity distribution of orthogonal cross-section to a traveling direction of the laser beam is Gaussian distribution, and the light irradiation intensity of the center of light irradiation has enormously been intense compared to that of the periphery. When the laser beam of Gaussian distribution is irradiated to the thermoreversible recording medium, the temperature at the center is increased too much, and if forming and erasing of images are repeated, the irradiated area is degraded and repetitive number is lowered. Furthermore, when irradiation energy of laser beam is lowered so as not to increase the temperature of the center to the level which causes degradation, image size is decreased and a problem of degraded image contrast or prolonged time for image forming arises.

With that, light irradiation intensity of the center is set to be equivalent to or less than the light irradiation intensity of the periphery in the light intensity distribution of orthogonal cross-section to a traveling direction of the laser beam irradiated at least in any one of the image forming step and the image erasing step of the method for image processing of the present invention in order to realize improvement of repetition durability while suppressing the degradation of the thermoreversible recording medium due to repetitive forming and erasing of images and maintaining image contrast without reducing the size of images.

Moreover, it is satisfactory if the light irradiation intensity of the center is equal to or less than the light irradiation intensity of the periphery in the light intensity distribution of cross-section perpendicular to the traveling direction of the laser beam irradiated at least in any one of the image forming step and image erasing step in the method for image processing of the present invention. When the light irradiation intensity of the center is equal to or less than the light irradiation intensity of the periphery in the image forming step, the light irradiation intensity of the center does not have to be equal to or less than the light irradiation intensity of the periphery in the image erasing step, and a heat source other than the laser beam may also be used. When the recording medium is heated by irradiating a laser beam and the information is erased in a short period of time, it is preferably erased by heating with heat sources such as infrared lamp, heat roller, hot stamp, dryer, etc. because it takes time for irradiating the entire predetermined area by scanning one laser beam. Furthermore, when the thermoreversible recording medium is attached to a foamed polystyrene box as a delivery container used in the physical distribution line, the information is preferably erased by heating only the thermoreversible recording medium locally by irradiating a laser beam to avoid melting of the foamed polystyrene box by heating.

When the light irradiation intensity of the center is equal to or less than the light irradiation intensity of the periphery in the image erasing step, the light irradiation intensity of the center does not have to be equal to or less than the light irradiation intensity of the periphery in the image forming step, and a heat source other than the laser beam such as thermal head may be used, for example.

[Center and Periphery in the Light Intensity Distribution]

The "center" in the light intensity distribution of cross-section in a direction approximately perpendicular to the traveling direction of the laser beam is defined as a region which corresponds to the area sandwiched by two maximum peak tops, which is convexed down, of differentiation curves produced by differentiating the curve expressing the light intensity distribution twice, and "periphery" is defined as a region which corresponds to the area other than the "center".

The "light irradiation intensity of the center" is defined respectively as its peak top when the light intensity distribution of the center is expressed by a curve, the light irradiation intensity at the peak top when the shape of the light intensity distribution curve is convexed up, and the light intensity of the peak bottom when the shape of the light intensity distribution curve is convexed down. Furthermore, when the shape of the light intensity distribution curve is both convexed up and down, it is defined as the light irradiation intensity of the peak top located more close to the center in the center portion.

Moreover, it is defined as the light irradiation intensity of the highest part of the straight line when the light intensity distribution of the center is expressed by a straight line and in this case, the light irradiation intensity is preferably constant (the light intensity distribution of the center is expressed by a horizontal line) in the center.

The "light irradiation intensity of the periphery" at the same time, is defined as the light irradiation intensity of the highest part when the light intensity distribution in the periphery is expressed by either curve or straight line.

Examples of the light irradiation intensity of the "center" and the "periphery" in the light intensity distribution of orthogonal cross-section to a traveling direction of the laser beam are shown in FIGS. 1A to 1E. Meanwhile, the each curve in FIGS. 1A to 1E respectively shows from the top a curve expressing light intensity distribution, a differentiation curve (X'), which is a curve expressing the light intensity distribution differentiated once, and a differentiation curve (X"), which is a curve expressing the light intensity distribution differentiated twice.

FIGS. 1A to 1D show light intensity distributions of the laser beam used in the method for image processing of the present invention and the light irradiation intensity of the center is equal to or less than the light irradiation intensity of the periphery.

Figure 1B:
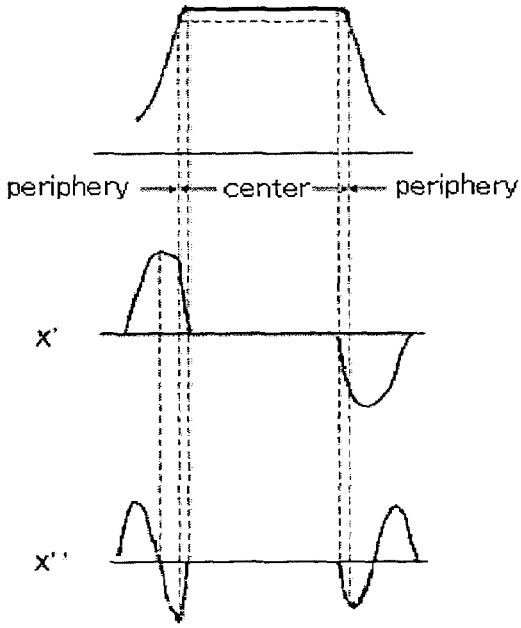
FIG. 1B is a schematic diagram showing an exemplary light irradiation intensity of the "center" and the "periphery" in the light intensity distribution of orthogonal cross-section to a traveling direction of the laser beam used in the method for image processing of the present invention.
Figure 1C:
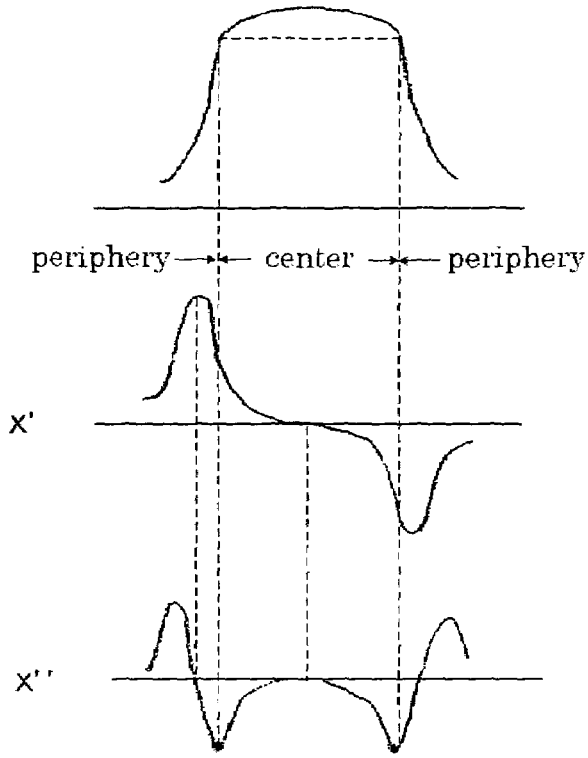
FIG. 1C is a schematic diagram showing an exemplary light irradiation intensity of the "center" and the "periphery" in the light intensity distribution of orthogonal cross-section to a traveling direction of the laser beam used in the method for image processing of the present invention.
Figure 1D:
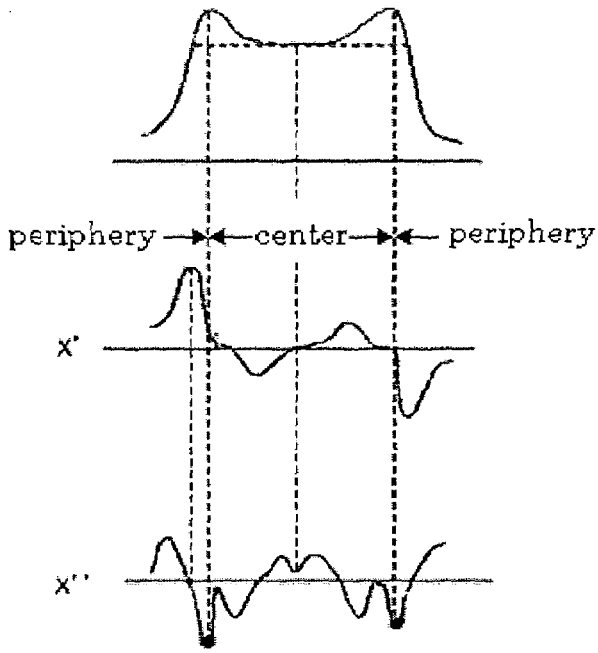
FIG. 1D is a schematic diagram showing an exemplary light irradiation intensity of the "center" and the "periphery" in the light intensity distribution of orthogonal cross-section to a traveling direction of the laser beam used in the method for image processing of the present invention.
Figure 1E:
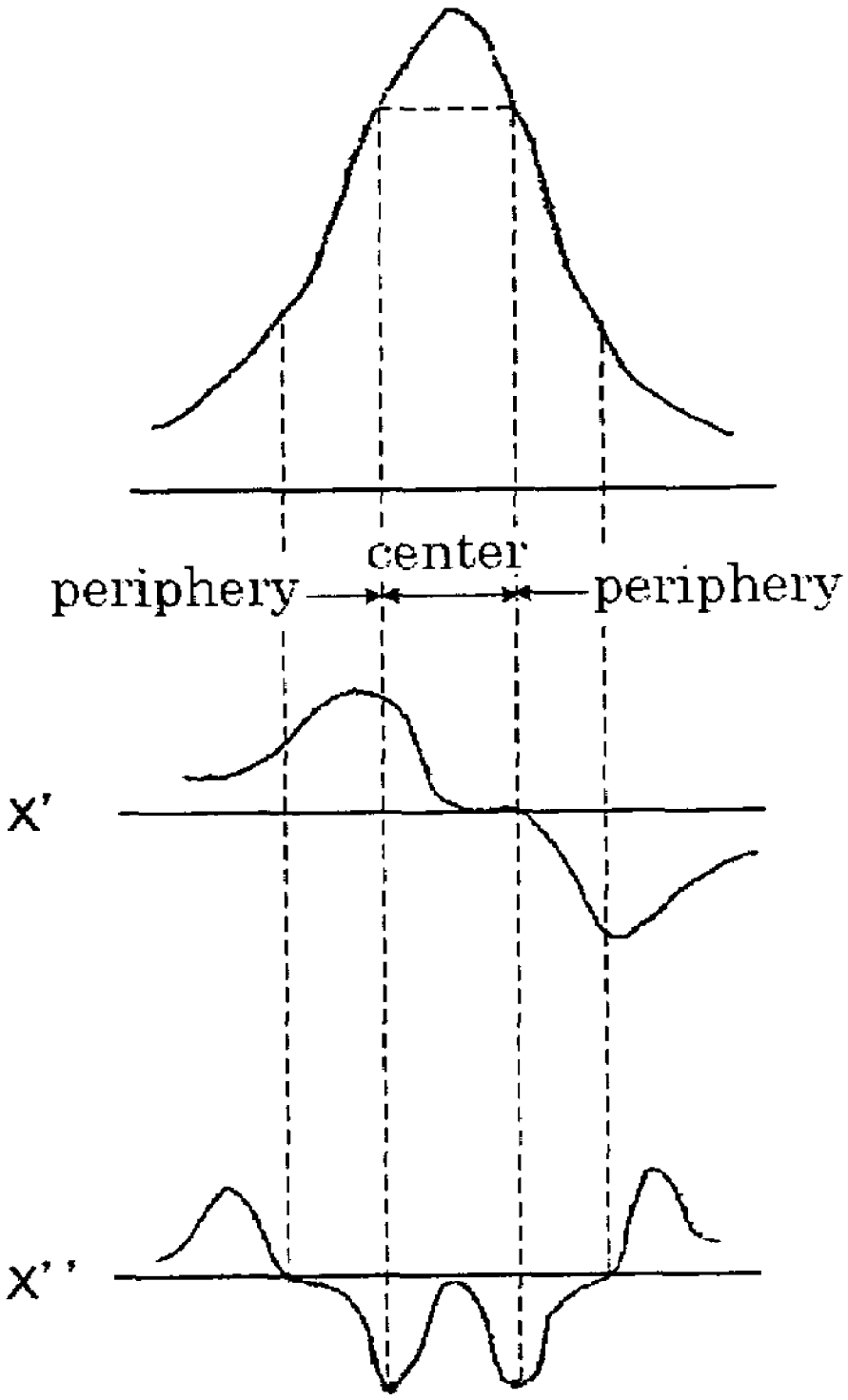
FIG. 1E is a schematic diagram showing the light irradiation intensity of the "center" and the "periphery" in the light intensity distribution (Gaussian distribution) of orthogonal cross-section to a traveling direction of the normal laser beam.

At the same time, FIG. 1E shows a light intensity distribution of a normal laser beam in Gaussian distribution and the light irradiation intensity of the center is enormously intense compared to the light irradiation intensity of the periphery.

With regard to the relation between the light irradiation intensity of the center and the periphery in the light intensity distribution of orthogonal cross-section to a traveling direction of the laser beam, the light irradiation intensity of the center needs to be equivalent to or less than the light irradiation intensity of the periphery. Being equivalent or less means it is 1.05 times or less than 1.05 times of the light irradiation intensity of the periphery and it is preferably 1.03 times or less and more preferably 1.0 time or less, and the light irradiation intensity of the center is most preferably smaller than the light irradiation intensity of the periphery, that is, less than 1.0 time.

When the light irradiation intensity of the center is 1.05 times or less of the light irradiation intensity of the periphery, the degradation of the thermoreversible recording medium due to temperature rise in the center can be suppressed.

In contrast, lower limits of the light irradiation intensity of the center are not particularly limited and may be adjusted accordingly. It is preferably 0.1 times or more and more preferably 0.3 times or more of the light irradiation intensity of the periphery.

When the light irradiation intensity of the center is less than 0.1 times of the light irradiation intensity of the periphery, the temperature of the irradiation spot of the laser beam in the thermoreversible recording medium is not raised sufficiently and the image density of the center may be lowered compared to that of the periphery or may not be erased sufficiently.

The laser which emits the laser beams is not particularly limited and may be selected from know lasers and examples include $CO_2$ laser, YAG laser, fiber laser and laser diode (LD).

The light intensity distribution of orthogonal cross-section to the traveling direction of the laser beam can be performed by using a laser beam profiler using CCD, etc. when the laser beam is emitted from laser diode, YAG laser, etc. and has a wavelength of near infrared area, for example. Moreover, when the laser beam is emitted from $CO_2$ laser and has a wavelength of far infrared area, a combination of beam splitter and power meter, beam analyzer for high power using high-sensitive, pyroelectric camera, and the like may be used because CCD is not usable.

The method for changing the light intensity distribution of orthogonal cross-section to the traveling direction of the laser beam from Gaussian distribution to the one in which the light irradiation intensity of the center is equal to or less than the light irradiation intensity of the periphery is not particularly limited and may be selected accordingly. The light irradiation intensity adjusting unit can be suitably used.

Preferred examples of the light irradiation intensity adjusting unit include lens, filter, mask and mirror, etc. Specifically, kaleidoscope, integrater, beam homogenizer and aspheric beam shaper (a combination of intensity transformation lens and phase correction lens), etc. are preferable. Moreover, when filters and masks, etc. are used, light irradiation intensity may be adjusted by physically cutting the center of the laser beam. And when the mirror is used, light irradiation intensity can be adjusted by using a deformable mirror of which the shape can be changed mechanically in conjunction with computers or a mirror in which reflectance or surface irregularity partially differs.

Moreover, it is possible to adjust the light irradiation intensity by displacing the distance between the thermoreversible recording medium and the lens from the focusing distance and in addition, adjustment of light irradiation intensity can be easily performed by fiber coupling of laser diode, YAG laser, and the like.

Meanwhile, the method for adjusting light irradiation intensity by the light irradiation intensity adjusting unit will be described in detail with the explanation of the image processing apparatus of the present invention, which will be described later.

—Second Aspect—

In the second aspect of the method for image processing of the present invention, the image erasing step includes image erasing in the second image erasing area which is adjacent to the first image erasing area after images are erased in the first image erasing area by scanning the laser beam, and the distance between the laser beam irradiation position and the first image erasing area and the laser beam irradiation position and the second image erasing area is 1/12 to 1/4 of the irradiation spot diameter of the laser beam.

As the distance of the laser beam irradiation position gets smaller, the irradiated area is heated to a uniform temperature and images can be erased uniformly, however, if images formed in a wide range are erased, it is time-consuming. In contrast, as the distance of the laser beam irradiation position is widened, it becomes possible to erase the images formed in the wide range and thus to erase the images in a short period of time, however, if the distance of the laser beam irradiation position is widened too much, heating becomes uneven, and erase defects may occur.

In this aspect, because distances between the laser beam irradiation position and the first image erasing area and the laser beam irradiation position and the second image erasing area which are adjacent to each other is 1/12 to 1/4 of the irradiation spot diameter of the laser beam, images can be erased uniformly in a short period of time.

[Irradiation Spot Diameter]

Figure 2A:
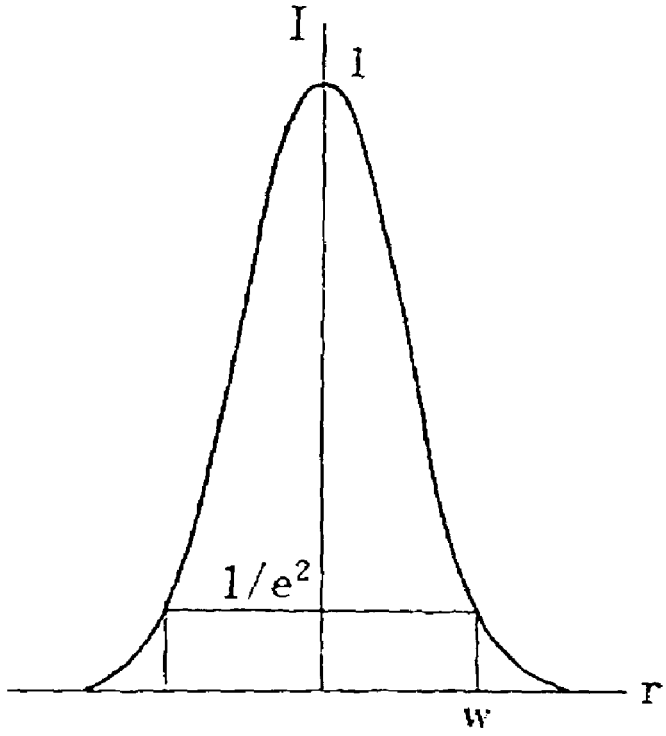
FIG. 2A is a schematic diagram for describing spot diameter of the laser beam of which the light intensity distribution is a Gaussian distribution.
Figure 2B:
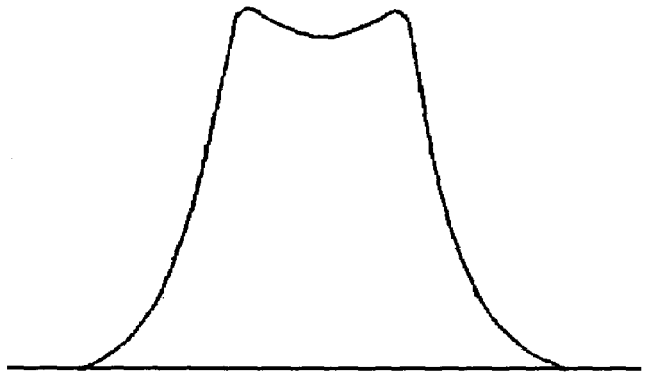
FIG. 2B is a schematic diagram for describing spot diameter of the laser beam used in the method for image processing of the present invention.

In general, the light intensity distribution of orthogonal cross-section to the traveling direction of output beam of the laser light is an approximate Gaussian distribution (the light intensity distribution of Gaussian beam) and the Gaussian beam is characterized by the shape of the light intensity distribution of orthogonal cross-section to the traveling direction which is identical despite the transmission position of the beam. The light intensity distribution is expressed by the following equation 1, and the diameter which is $1/e^2$ of the center intensity is called irradiation spot diameter (or spot size, beam diameter, and the like) and 86.5% of entire light amount is contained in the irradiation spot diameter as shown in FIG. 2A. However, in the first aspect of the method for image processing having the light intensity distribution as shown in FIG. 2B, a diameter containing 86.5% of entire light amount is defined as irradiation spot diameter instead of the diameter which is $1/e^2$ of the center intensity.

$$I=2P/\pi w^2\cdot\exp(-2r^2/w^2) \qquad \text{Equation 1}$$

In the above Equation 1, "r" represents a distance from the center of the laser, "w" represents a diameter ($1/e^2$ of the center intensity) of the laser beam and "P" represents a laser power.

The distances between the laser beam irradiation position and the first image erasing area and the laser beam irradiation position and the second image erasing area are not particularly limited as long as they are 1/12 to 1/4 of the irradiation spot diameter of the laser beam and may be adjusted accordingly. The lower limit is preferably 1/10 or more and more preferably 1/8 or more. The upper limit is preferably 1/5 or less.

The method for controlling the distance between the laser beam irradiation position and the image erasing area is not particularly limited and may be selected accordingly. Examples include a method for controlling distances in which one of after-mentioned galvano meters is activated.

The image density of the image erasing area after image erasing is preferably 1.60 or more as measured by using a Macbeth densitometer (RD914) when transparency of the thermoreversible recording medium is changed reversibly depending on temperatures and it is preferably 0.09 or less when color tone of the thermoreversible recording medium is changed reversibly depending on temperatures. In this case, images are found to be erased completely. Meanwhile, in the aspect in which transparency of the thermoreversible recording medium is changed reversibly, a black paper (O.D.2.0) is placed on back for measurement.

The irradiation spot diameter of the laser beam in the image erasing step is preferably 1.2 times to 38 times of the irradiation spot diameter of the laser beam in the image forming step.

If the irradiation spot diameter of the laser beam in the image erasing step is more than 38 times of the irradiation spot diameter of the laser beam in the image forming step, laser output required for heating an area to a constant temperature is increased and may lead to a grow in size of apparatus. Moreover, if scan speed is slowed in order to heat an area to a constant temperature without increasing the laser output, it takes time to erase images.

The irradiation spot diameter of the laser beam in the image erasing step is preferable since images formed in a wide range may be erased uniformly in a short period of time as the diameter becomes larger. The lower limit relative to the irradiation spot diameter of the laser beam in the image forming step is more preferably 1.5 times or more, still more preferably 2 times or more and most preferably 3 times or more.

The upper limit of the irradiation spot diameter of the laser beam in the image erasing step relative to the irradiation spot diameter of the laser beam in the image forming step is more preferably 35 times or less and still more preferably 20 times or less.

Specifically, the irradiation spot diameter of the laser beam in the image erasing step is preferably 1.7 mm to 6.9 mm and more preferably 2.0 mm to 6.0 mm. On the other hand, the irradiation spot diameter of the laser beam in the image forming step is preferably 0.18 mm to 1.5 mm.

The method for changing the irradiation spot diameter of the laser beam in the image erasing step to 1.2 times to 38 times of the irradiation spot diameter of the laser beam in the image forming step is not particularly limited and may be selected accordingly. Examples include a method for changing irradiation spot diameter of the laser beams for image forming and image erasing by moving fθ lens or the thermoreversible recording medium in an irradiation direction of the laser beams, a method in which 2 lines of optical systems such as scanning unit, fθ lens, and the like are provided and the light path is switched by using identical optical resonator, a method using two recording apparatuses for image forming and image erasing.

In the second aspect of the method for image processing of the present invention, it is preferable that the light irradiation intensity of the center is equal to or less than the light irradiation intensity of the periphery in the light intensity distribution of cross-section in a direction approximately perpendicular to the traveling direction of the laser beam which is irradiated at least in any one of the image forming step and the image erasing step. In this case, degradation of the thermoreversible recording medium due to repetitive forming and erasing of images can be suppressed and repetition durability can be improved while retaining image contrast.

Furthermore, images can be erased in a shorter period of time even though scan speed of the laser beam is increased because the thermoreversible recording medium is heated uniformly.

Meanwhile, the detail of the relation between the light irradiation intensity of the center and the light irradiation intensity of the periphery in the light intensity distribution of cross-section in a direction approximately perpendicular to the traveling direction of the laser beam is as described above.

—Third Aspect—

In the third aspect of the method for image processing of the present invention, the thermoreversible recording medium contains at least a resin and an organic low-molecular material, and the image forming step includes image forming in the second image forming area which is adjacent to the first image forming area after images are formed in the first image forming area. And the laser beam is irradiated to the second image forming area in a way so that it is overlapped with part of the first image forming area after the organic low-molecular material, which is placed in the first image forming area, is melted prior to crystallization.

When images are formed by scanning the laser beam in the image forming step and it is necessary to form thick line width more than the line width which is formable by one scan, it is necessary to scan the laser beam in an area where it is adjacent to the line formed by the first scan twice or more times. At this time, when the second scan is performed in the area where it is adjacent to the image formed by the first scan, an image erasing temperature area which is lower than the image forming temperature appears between the first scan spot and the second scan spot and a problem arises such that part of the images formed by the first scan is erased, leading to degradation of image uniformity and image density. This has been a principle problem of the thermoreversible recording medium in which forming and erasing of images are performed by temperature differences.

With that, a dedicated study has been conducted on color developing and erasing mechanism of the thermoreversible recording medium and as a result, it turns out that when a laser beam is irradiated to form images by the first scan and the thermoreversible recording medium is heated to melt the organic low-molecular material in the reversible thermosensitive recording layer (recording layer), and a laser beam is then irradiated by the second scan to the area where it is adjacent to the image formed by the first scan before the organic low-molecular material is crystallized, the image formed by the first scan in the boundary portion of the laser beam irradiation area by the first scan and the second scan is not erased, enabling to obtain high density, uniform and appropriate images and thereby completing the third aspect of the method for image processing of the present invention.

<Image Forming and Erasing Mechanism>

There are an aspect in which transparency is reversibly changed depending on temperatures and an aspect in which color tone is reversibly changed depending on temperatures for the image forming and erasing mechanism.

In the aspect in which transparency is changed reversibly, the organic low-molecule in the thermoreversible recording medium is dispersed in a resin in form of particle and transparency is changed reversibly between clear state and clouded state depending on temperatures.

The observation of the change in transparency is originated in the following phenomenon. That is, (1) in clear state, since particles of the organic low-molecular material dispersed in the resin base material and the resin base material are attached firmly to each other without interspaces and no airspace exists inside the particles, the incoming light from one side is transmitted to the other side without scattering and it looks transparent. (2) In clouded state, on the other hand, since the particles of the organic low-molecular material are formed of microscopic crystals of the organic low-molecular material and interspaces (airspaces) generate in the interface of the crystals or the interface between the particles and the resin base material, the incoming light from one side is refracted and scattered in the interface between airspaces and crystals or the interface between airspaces and the resin, thus it looks white.

Figure 3A:
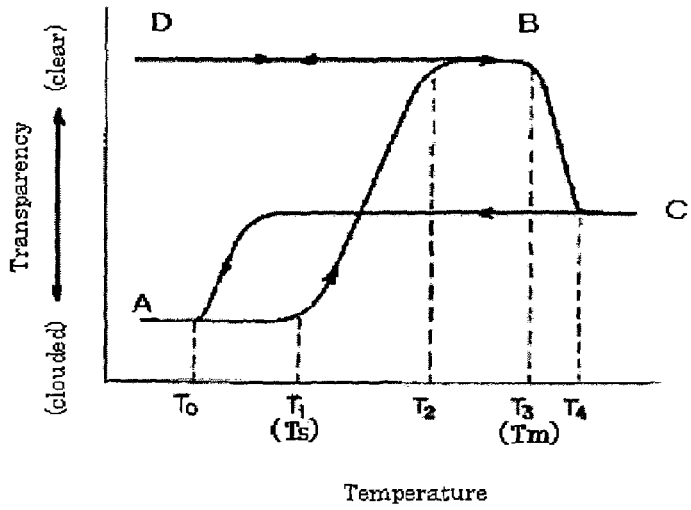
FIG. 3A is a graph showing clear and clouded properties of a thermoreversible recording medium.

First, an example of the temperature-transparency conversion curve of the thermoreversible recording medium containing a reversible thermosensitive recording layer (hereinafter may be referred to as "recording layer") in which the organic low-molecular material is dispersed in the resin is shown in FIG. 3A.

The recording layer is in a clouded opaque state (A) at room temperatures of $T_0$ or less, for example. When the layer is heated, it gradually begins to turn transparent at a temperature $T_1$, it becomes transparent (B) when heated to temperatures $T_2$ to $T_3$ and it stays transparent (D) even it is returned to the room temperatures $T_0$ or less again from the transparent (B) state. This is thought to be because the resin starts to get soften around the temperature $T_1$ and the resin is contracted as the softening progresses, reducing the interface between the resin and the particles of the organic low-molecular material or the airspace inside the particles and transparency increases gradually. The organic low-molecular material is in a half-molten state at temperatures $T_2$ to $T_3$ and it becomes transparent by filling the residual airspaces with the organic low-molecular material and when it is cooled with seed crystals left, it is crystallized with a relatively high temperature. Since the resin is still in a softened state at this time, the resin follows the volume change of the particles associated with crystallization and the airspace does not appear, thereby retaining clear state.

When the recording layer is further heated to the temperature of $T_4$ or more, it becomes half-transparent (C), which is an intermediate state between maximum transparency and maximum opacity. When the temperature is lowered, it returns to the initial clouded opaque state (A) without returning its clear state again. This is thought to be because the recording layer is in an excessively-cooled state after the organic low-molecular material is completely melted with a temperature of $T_4$ or more and is crystallized at a slightly higher temperature than $T_0$, and the resin cannot follow the volume change of the particles associated with crystallization, allowing airspaces to appear.

However, in the temperature-transparency conversion curve as shown in FIG. 3A, transparency of each state may change according to the type of the resin and the organic low-molecular material, etc.

Figure 3B:
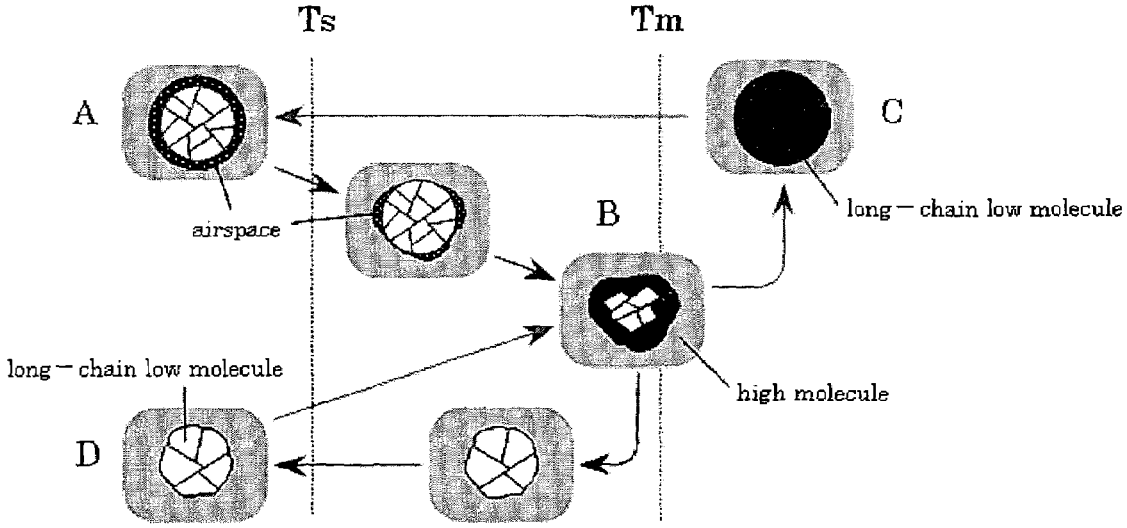
FIG. 3B is a schematic diagram showing a mechanism of changes between clear state and clouded state of a thermoreversible recording medium.

The mechanism of transparency change of the thermoreversible recording medium in which clear state and clouded state are reversibly changed by heat is shown in FIG. 3B.

One long-chain low-molecular particle and surrounding high molecules are taken out and appearance and disappearance of the airspace associated with heating and cooling are shown in FIG. 3B. In clouded state (A), airspace appears between high molecule and low-molecular particle (or inside the particle) and is in a light-scattering state. When this is heated to more than the softening point (Ts) of the high molecule, the space is reduced and transparency is increased. When it is further heated to near the melting point (Tm) of the low-molecular particle, part of the low-molecular particle is melted, the airspace is filled with the low-molecular particle due to volume expansion of the molten low-molecular particle and disappears and it becomes transparent (B). When it is cooled from hereon, the low-molecular particle is crystallized right below the melting point, airspace does not appear, and clear state (D) is retained even at room temperatures.

When it is then heated to more than the melting point of the low-molecular particle, difference in refractive index occurs between molten low-molecular particle and surrounding high molecule and it becomes half transparent (C). When it is cooled to a room temperature from hereon, the low-molecular particle is crystallized at less than the softening point of the high molecule due to excessive cooling phenomenon, and because the high molecule is in a glass state at this time and surrounding high molecule cannot follow the volume reduction associated with the crystallization of the low-molecular particle, airspace appears and it returns to original clouded state (A).

As described above, it is thought to be in a clouded state because the organic low-molecular material is in molten state, it is excessively cooled even if it is heated to an image erasing temperature before the organic low-molecular material is crystallized and the airspace appears for the resin cannot follow the volume change associated with the crystallization of the organic low-molecular material.

In the aspect in which color tone is reversibly changed depending on temperatures, the organic low-molecular material before melting is a leuco dye and reversible developer (hereinafter may be referred to as "developer") and the molten organic low-molecular material before crystallization is the leuco dye and the developer and the color tone is reversibly changed between clear state and color developing state by heat.

Figure 4A:
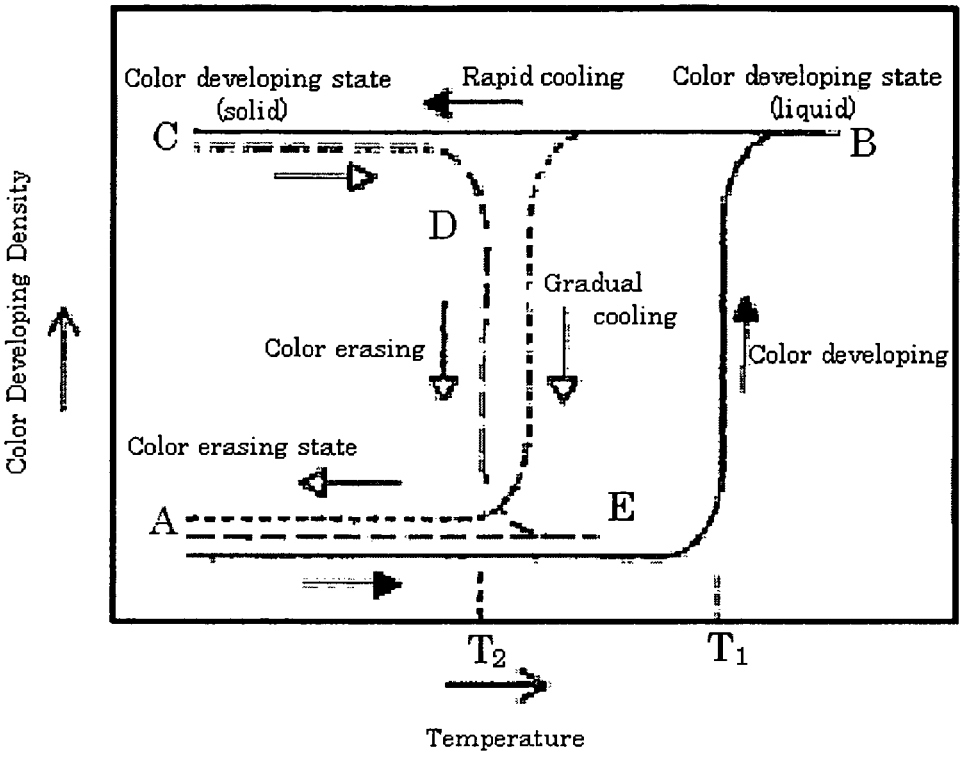
FIG. 4A is a graph showing color developing and color erasing properties of a thermoreversible recording medium.
Figure 4B:
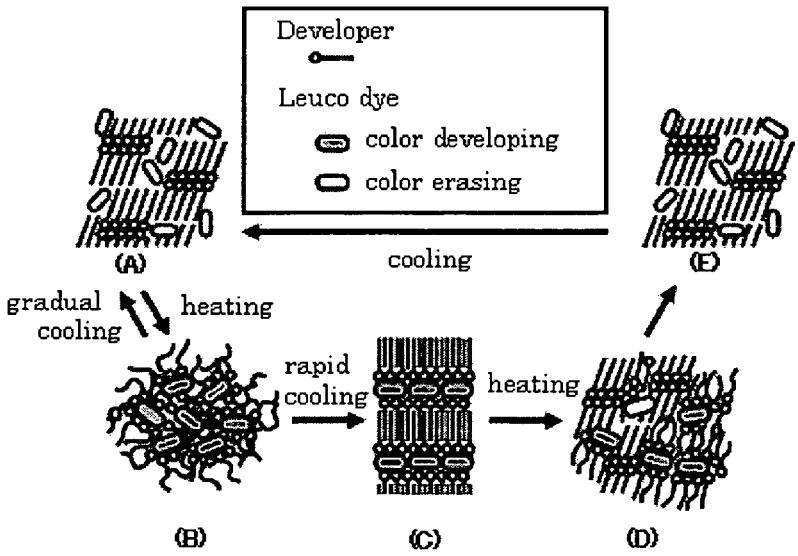
FIG. 4B is a schematic diagram showing a mechanism of changes between color developing and color erasing of a thermoreversible recording medium.

An example of the temperature-color developing density conversion curve of the thermoreversible recording medium having a reversible thermosensitive recording layer in which the leuco dye and the developer are contained in the resin is shown in FIG. 4A. And color developing and erasing mechanism of the thermoreversible recording medium in which clear state and color developing state are reversibly changed by heat is shown in FIG. 4B.

First, the recording layer which is in a color erasing state (A) is heated, the leuco dye and the developer are melted and mixed at a melting temperature $T_1$ and color is developed and the recording layer is in a molten color-developing state (B). When it is cooled rapidly from the molten color-developing state (B), it can be cooled to a room temperature while in a color developing state and the color developing state is stabilized to be a fixed color developing state (C). Whether or not this color developing state is obtained depends on the cooling rate from the molten state and when it is cooled gradually, color erasing occurs in cooling step and it returns to its original color erasing state (A) or a state of relatively lower density than the color developing state (C) by rapid cooling. In contrast, when the recording layer is again heated from the color developing state (C), color erasing occurs at a temperature $T_2$ which is lower than the color developing temperature (from D to E) and when it is cooled in this state, the recording layer returns to its original state, color erasing state (A).

The color developing state (C), which is obtained by rapid cooling from the molten state, is a state in which the leuco dye and the developer are mixed in a way so that molecules may come in contact with each other to induce reaction, and it often is in a solid state. This state is a state in which a molten mixture (the color developing mixture) of the leuco dye and the developer is crystallized to retain the color developing state, and the color developing is thought to be stabilized by forming this structure. On the other hand, color erasing state is a state in which the leuco dye and the developer are in phase separation state. This state is a state in which molecules of at least one of compounds are gathered to form domains or are in crystallized state and the leuco dye and the developer are thought to be separated and in a stabilized state by agglomeration or crystallization. In many cases, more complete color erasing occurs due to the phase separation of the leuco dye and the developer and crystallization of the developer.

Meanwhile, aggregation structure changes at $T_2$ and phase separation or crystallization of the developer occur in both of color erasing due to gradual cooling from the molten state and due to temperature rise from the color developing state.

As described above, when the recording layer is heated to an image erasing temperature before crystallization of the color developing mixture, which is formed of the molten developer and the leuco dye, the separation between the leuco dye and the developer is prevented and the color developing state is thought to be retained as a result.

The interval (time interval) between laser beam irradiation in the first image forming area and the laser beam irradiation in the second image forming area is not particularly limited and may be selected according to the type of the organic low-molecular material and it is preferably 60 seconds or less, more preferably 10 seconds or less, still more preferably 1.0 seconds or less and most preferably 0.1 seconds or less.

When the interval (time interval) is more than 60 seconds, the organic low-molecular material is crystallized and an area of low image density appears in the boundary portion between the image formed on the first image forming area and the image formed on the second image forming area, and uniform images may not be obtained.

A method for confirming that it is in a state where the organic low-molecular material is melted prior to crystallization, and a method for measuring the time it takes until the organic low-molecular material is crystallized after being melted are not particularly limited and may be selected accordingly. For example, these may be done by forming a linear image and after predetermined time, forming another linear image so as to be overlapped with the first linear image in a vertical direction and then determining if these intersecting points have been erased. When these intersecting points have been erased, it can be confirmed that the organic low-molecular material is crystallized.

The state in which intersecting points are erased is defined as a state in which the image density of the linear image including the intersecting points is 1.2 or more in an aspect in which transparency of the thermoreversible recording medium is changed reversibly and the image density is 0.5 or less in an aspect in which color tone of the thermoreversible recording medium is changed reversibly as measured continuously by using a Macbeth densitometer (RD914). Meanwhile, in the aspect in which transparency of the thermoreversible recording medium is changed reversibly, a black paper (O.D.2.0) is placed on back for measurement.

Moreover, crystallization may be confirmed by X-ray analysis of the thermoreversible recording medium. When the organic low-molecular material is crystallized, scattered peak corresponding to its unique crystallization structure according to the type of the organic low-molecular material can be detected by X-ray analysis. The position of the scattered peak can be easily confirmed by performing an independent X-ray analysis for organic low-molecular material. Furthermore, since it is also possible to perform measurement by X-ray analyzers while changing temperatures, crystallization process of the organic low-molecular material can be checked after heating and melting the organic low-molecular material.

The scan speed of the laser beam is not particularly limited and may be selected accordingly and it is preferably 300 mm/s or more, more preferably 500 mm/s or more and most preferably 700 mm/s or more.

If the scan speed is less than 300 mm/s, the organic low-molecular material is crystallized, and an area of low image density appears in the boundary portion of the image formed in the first image forming area and the image formed in the second image forming area and image density may be uneven.

The upper limit of the scan speed of the laser beam is not particularly limited and may be adjusted accordingly and it is preferably 20,000 mm/s or less, more preferably 15,000 mm/s or less and most preferably 10,000 mm/s or less.

When the scan speed is more than 20,000 mm/s, it may be difficult to form uniform images.

In the third aspect of the method for image processing of the present invention, it is also preferable that the light irradiation intensity of the center is equal to or less than the light irradiation intensity of the periphery in the light intensity distribution of cross-section in a direction approximately perpendicular to the traveling direction of the laser beam which is irradiated at least in any one of the image forming step and the image erasing step. In the above aspect, degradation of the thermoreversible recording medium due to repetitive forming and erasing of images is suppressed and repetition durability can be improved while retaining image contrast.

Meanwhile, the detail of the relation between the light irradiation intensity of the center and the light irradiation intensity of the periphery in the light intensity distribution of cross-section in a direction approximately perpendicular to the traveling direction of the laser beam is as described above.

[Thermoreversible Recording Medium]

The thermoreversible recording medium used for the method for image processing of the present invention contains at least a support and a reversible thermosensitive recording layer, and further contains other layers such as protective layer, intermediate layer, undercoat layer, back layer, photothermal conversion layer, adhesion layer, sticking layer, coloring layer, air layer, optical reflective layer, and the like suitably selected as necessary. Each of these layers may be of a single layer structure or a multilayer structure.

—Support—

The shape, structure and size, etc. of the support are not particularly limited and may be selected accordingly. Examples of the shape include flat plate, examples of the structure include single layer structure and multilayer structure and the size may be selected according to the size, etc. of the thermoreversible recording medium.

Examples of material for the support include inorganic material and organic material.

Examples of the inorganic material include glass, quartz, silicon, silicon oxide, aluminum oxide, $SiO_2$ and metal.

Examples of the organic material include paper, cellulose derivatives such as cellulose triacetate, synthetic paper, films such as polyethylene terephthalate, polycarbonate, polystyrene, polymethylmethacrylate, and the like.

These inorganic materials and organic materials may be used alone or in combination. Of these, organic material and films such as polyethylene terephthalate, polycarbonate, polymethylmethacrylate, and the like are preferable and polyethylene terephthalate is particularly preferable.

It is preferable to reform the support surface by performing corona discharge, oxidation reaction (chromic acid), etching, simple bonding, antistatic treatment, and the like in order to improve adhesive property of the coating layers.

It is also preferable for the support to be white-colored by adding white pigment such as titanium oxide, etc.

The thickness of the support is not particularly limited and may be selected accordingly and it is preferably 10 μm to 2,000 μm and more preferably 50 μm to 1,000 μm.

—Reversible Thermosensitive Recording Layer—

The reversible thermosensitive recording layer (hereinafter may be referred to as "recording layer") contains at least a material in which any one of transparency and color tone changes reversibly depending on temperatures and further contains other components as necessary.

The material in which any one of transparency and color tone changes reversibly is a material which is capable of exhibiting a phenomenon in which observable changes occur reversibly by temperature changes and it is changeable to color developing state and color erasing state comparatively by heating temperatures and the difference in cooling rate after heating. The observable changes can be divided into the change in state of color and the change in shape. The change in state of color is caused by the change in transmittance, reflectivity, absorption wavelength, degree of scattering, and the like, for example, and the state of color in the thermoreversible recording medium practically changes depending on the combination of these changes.

The material in which any one of transparency and color tone changes reversibly depending on temperatures is not particularly limited and may be selected from known materials. Examples include a mixed material of 2 or more polymers which changes between clear state and clouded state by the difference in solubility condition (JP-A No. 61-258853), a material using phase changes of liquid crystal polymers (JP-A No. 62-66990) and a material which is in a first state of color at a first predetermined temperature higher than room temperatures and is in a second state of color by being heated to a second predetermined temperature higher than the first predetermined temperature and then cooled.

Of these, a material of which state of color changes between the first predetermined temperature and the second predetermined temperature is particularly preferable because temperatures can be easily controlled and high contrast is obtainable.

Examples include a material which is in a first state of color at a first predetermined temperature higher than room temperatures and is in a second state of color by being heated to a second predetermined temperature higher than the first predetermined temperature and then cooled, and a material further heated to a third predetermined temperature or more, which is higher than the second predetermined temperature.

Examples of such materials include a material which becomes transparent at a first predetermined temperature and becomes clouded at a second predetermined temperature (JP-A No. 55-154198), a material which develops color at a second predetermined temperature and erases color at a first predetermined temperature (JP-A Nos. 4-224996, 4-247985 and 4-267190), a material which become clouded at a first predetermined temperature and become transparent at a second predetermined temperature (JP-A No. 3-169590) and a material which develops colors such as black, red and blue, etc. at a first predetermined temperature and erases colors at a second predetermined temperature (JP-A Nos. 2-188293 and 2-188294).

Of these, a thermoreversible recording medium containing resin base material and organic low-molecular material which is dispersed in the resin base material such as higher fatty acids is advantageous in having a relatively low second predetermined temperature and first predetermined temperature and being able to perform erasing and printing with low energy. Moreover, because the color developing and erasing mechanism is a physical change which depends on the solidification of resins and crystallization of organic low-molecular materials, it has a strong resistance to environment.

Furthermore, because the thermoreversible recording medium containing after-mentioned leuco dye and reversible developer, which develops colors at a second predetermined temperature and erases colors at a first predetermined temperature, exhibits clear state and color developing state reversibly and exhibits black, blue and other colors in color developing state, it is possible to obtain high-contrast images.

The organic low-molecular material (a material which is dispersed in resin base materials and becomes transparent at a first predetermined temperature and becomes clouded at a second predetermined temperature) in the thermoreversible recording medium used in the third aspect of the method for image processing is not particularly limited as long as it is a material which changes from multicrystal to single crystal in the recording layer by heat and can be selected accordingly. In general, materials having a melting point of approximately 30° C. to 200° C. are usable and materials having a melting point of 50° C. to 150° C. are preferable.

Such organic low-molecular materials are not particularly limited and may be selected accordingly and examples include alkanol; alkanediol; halogen alkanol or halogen alkane diol; alkylamine; alkane; alkene; alkine; halogenalkane; halogenalkene; halogenalkine; cycloalkane; cycloalkene; cycloalkine; saturated or unsaturated, mono or dicarboxylic acid and ester, amide or ammonium salt thereof, saturated or unsaturated halogen fatty acid and ester, amide or ammonium salt thereof; aryl carboxylate and ester, amide or ammonium salt thereof; halogen allyl carboxylate and ester, amide or ammonium salt thereof, thioalcohol; thiocarboxylate and ester, amine or ammonium salt thereof; and carboxylate ester of thioalcohol. These may be used alone or in combination.

Carbon number of these compounds is preferably 10 to 60, more preferably 10 to 38 and most preferably 10 to 30. The alcohol group portion in the esters may be saturated or unsaturated and may be substituted with halogen.

The organic low-molecular material is preferably containing at least one type selected from oxygen, nitrogen, sulfur and halogen such as —OH, —COOH, —CONH—, —COOR, —NH—, —$NH_2$, —S—, —S—S—, —O—, halogen atom, and the like in its molecule, for example.

Further specifically, examples of these compounds include higher fatty acid such as lauric acid, dodecanoic acid, myristic acid, pentadecanoic acid, palmitic acid, stearic acid, behenic acid, nonadecane, arginic acid and oleic acid; and esters of higher fatty acids such as methyl stearate, tetradecyl stearate, octadecyl sterate, octadecyl laurate, tetradecyl palmitate, dodecyl behenate, and the like. Of these, higher fatty acid is preferable, higher fatty acids having a carbon number of 16 or more such as palmitic acid, stearic acid, behenic acid, lignoceric acid, and the like are more preferable and higher fatty acids having a carbon number of 16 to 24 are most preferable as an organic low-molecular material used in the third aspect of the method for image processing.

Above-mentioned organic low-molecular materials may be used by combining several types accordingly or combining with other materials having different melting points than that of the organic low-molecular materials in order to widen the temperature range in which the thermoreversible recording medium can be made transparent. These combinations of materials are disclosed in but not limited to JP-A Nos. 63-39378, 63-130380, Japanese Patent Application No. 63-14754 and JP-B No. 2615200.

The resin base material forms a layer in which the organic low-molecular materials are uniformly dispersed and retained as well as to provide an effect on transparency at maximum transparency. For this reason, the resin base material is preferably a resin having high transparency, mechanical stability and appropriate film-forming performance.

Such resins are not particularly limited and may be selected accordingly and examples include polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride; vinylidene chloride copolymers such as vinylidene chloride-vinyl chloride copolymer and vinylidene chloride-acrylonitrile copolymer; polyester; polyamide; polyacrylate, polymethacrylate, or acrylate-methacrylate copolymer; silicon resin; and the like. These may be used alone or in combination.

The ratio of the organic low-molecular material to the resin (resin base material) in the recording layer is preferably 2:1 to 1:16 and more preferably 1:2 to 1:8 in mass ratio.

When the ratio of the resin is less than 2:1, it may be difficult to form a film which retains the organic low-molecular material in the resin base material and when it is more than 1:16, it may be difficult to make the recording layer opaque because of lack of amount of the organic low-molecular material.

Other components such as high-boiling solvent, surfactant and the like may be added to the recording layer for ease in formation of transparent images other than the organic low-molecular material and the resin.

The high-boiling solvent is not particularly limited and may be selected accordingly and examples include tributyl phosphate, tri-2-ethylhexyl phosphate, triphenyl phosphate, tricresyl phosphate, butyl oleic acid, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethylbutyrate, methyl acetyl ricinolate, butyl acetyl ricinolate, butylphthalyl butylglycolate and tributyl acetyl citrate.

The surfactants and other components are not particularly limited and may be selected accordingly and examples include polyalcohol higher fatty acid ester; polyalcohol higher alkyl ether; lower olefin oxide adduct of polyalcohol higher fatty acid ester, higher alcohol, higher alkylphenol, higher fatty acid higher alkylamine, higher fatty acid amide, oil or polypropylene glycol; acetylene glycol; Na, Ca, Ba or Mg salt of higher alkylbenzene sulfonate; Ca, Ba or Mg salt of higher fatty acid, aromatic carboxylic acid, higher fatty acid sulfonate, aromatic sulfonate, mono ester of sulfuric acid or mono or di-ester phosphate; low-degree sulfate oil; poly long-chain alkyl acrylate; acrylic oligomer; poly long-chain alkyl methacrylate; monomer copolymer containing long-chain alkyl methacrylate-amine; styrene-maleic anhydride copolymer and olefin-maleic anhydride copolymer.

The method for preparing the recording layer is not particularly limited and may be selected accordingly. For example, the recording layer may be prepared by applying and drying a solution into which 2 components, the resin base material and the organic low-molecular material are dissolved, or a dispersion liquid, which is the solution (a solvent in which at least one type selected from the organic low-molecular material is insoluble) of the resin base material in which the organic low-molecular material is dispersed in form of particle, on a support, for example.

The solvent for preparing the recording layer is not particularly limited and may be selected according to the type of the resin base material and the organic low-molecular material and examples include tetrahydrofuran, methyl ethyl ketone, methyl isobutyl ketone, chloroform, carbon tetrachloride, ethanol, toluene, benzene, and the like. Meanwhile, the organic low-molecular material is deposited as particles and exists as dispersed in the obtained recording layer when the dispersion liquid as well as the solution was used.

The organic low-molecular material in the thermoreversible recording medium used in the third aspect of the method for image processing may contain the leuco dye and the reversible developer and may develop colors at a second predetermined temperature and erase colors at a first predetermined temperature.

The leuco dye itself is a colorless or light-colored precursor. The leuco dye is not particularly limited and may be selected from known leuco dyes and preferred examples include leuco compounds such as triphenylmethane phthalide, triarylmethane, fluoran, phenothiazine, thioferuolan, xanthene, indophthalyl, spiropyran, azaphthalide, chromenopyrazole, methine, rhodamineanilinolactam, rhodaminelactam, quinazoline, diazaxanthene and bislactone. Of these, leuco dye of fluoran or phthalide system are particularly preferable for excellent color developing and erasing properties, color, storage ability, etc. These may be used alone or in combination. By laminating layers which develops colors of different tones, it can be made applicable for multicolor and full colors.

The reversible developer is not particularly limited as long as it can develop or erase colors reversibly by heat and may be selected accordingly. Preferred examples include a compound having one or more structures selected from (1) a structure having a function to develop colors of the leuco dye (phenolic hydroxyl group, carboxylic group and phosphoric group, for example) and (2) a structure in which cohesive force between molecules is controlled (a structure to which long-chain hydrocarbon group is linked) within the molecule. Meanwhile, the linked site may have linking group of 2 or more valencies containing hetero molecule and at least any one of similar linking groups and aromatic groups may be contained in the long-chain hydrocarbon group.

Phenol is particularly preferable as (1) the structure having a function to develop colors of the leuco dye.

Long-chain hydrocarbon group having a carbon number of 8 or more is preferable as (2) the structure in which cohesive force between molecules is controlled and the carbon number is more preferably 11 or more and the upper limit of carbon number is preferably 40 or less and more preferably 30 or less.

Among the reversible developers, the phenol compound expressed by the following General Formula (1) is preferable and the phenol compound expressed by the following General Formula (2) is more preferable.

General Formula 1

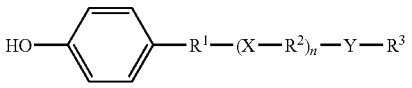

General Formula 2

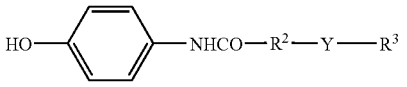

In General Formulas (1) and (2), "$R^1$" represents an aliphatic hydrocarbon group of single bond or having a carbon number of 1 to 24. "$R^2$" represents an aliphatic hydrocarbon group having a carbon number of 2 or more which may be substituted and the carbon number is preferably 5 or more and more preferably 10 or more. "$R^3$" represents an aliphatic hydrocarbon group having a carbon number of 1 to 35 and the carbon number is preferably 6 to 35 and more preferably 8 to 35. These aliphatic hydrocarbon groups may be contained alone or two or more types may be contained simultaneously.

The sum of the carbon numbers of "$R^1$", "$R^2$" and "$R^3$" is not particularly limited and may be selected accordingly and the lower limit is preferably 8 or more and more preferably 11 or more and upper limit is preferably 40 or less and more preferably 35 or less.

When the sum of carbon numbers is less than 8, color developing stability and color erasing property may be degraded.

The aliphatic hydrocarbon groups may be of straight chain, or branched chain and may contain unsaturated linkage and it is preferably of straight chain. Furthermore, examples of substituents linked to the hydrocarbon groups include hydroxyl group, halogen atom, alkoxy group, etc.

The "X" and "Y" may be identical or different and represent bivalent groups containing nitrogen atom or oxygen atom and specific examples include oxygen atom, amide group, urea group, diacylhydrazine group, oxalic diamide, acylurea group, and the like. Of these, it is preferably amide group and urea group.

"n" represents an integer of 0 and 1.

It is preferable for the reversible developer to be used simultaneously with a compound having at least one of —NHCO-group and —OCONH-group within the molecule as color erasure accelerator. In this case, interactions between molecules are induced between the color erasure accelerator and the reversible developer in the process of making a color erasing state and color developing and erasing properties are improved.

The color erasure accelerator is not particularly limited and may be selected accordingly and preferred examples include compounds expressed by the following General Formulas (3) to (9).

General Formula 3

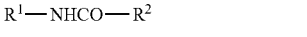

General Formula 4

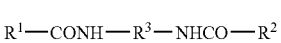

General Formula 5

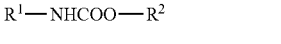

General Formula 6

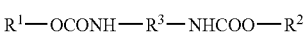

General Formula 7

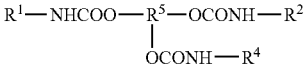

General Formula 8

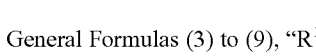

General Formula 9

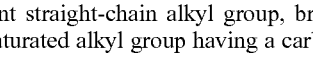

In General Formulas (3) to (9), "$R^1$", "$R^2$" and "$R^4$" represent straight-chain alkyl group, branched alkyl group or unsaturated alkyl group having a carbon number of 7 to 22. "$R^3$" represents a methylene group having a carbon number of 1 to 10. "$R^5$" represents trivalent functional group having a carbon number of 4 to 10.

The mixing ratio of the leuco dye and the reversible developer cannot be defined completely because suitable range changes depending on the combination of used compounds, however, the reversible developer is preferably about 0.1 to 20 and more preferably about 0.2 to 10 relative to the leuco dye which is 1 in mole ratio.

When the reversible developer is less than 0.1 and more than 20, density of color developing state may be degraded.

When the color erasure accelerator is added, the additive amount is preferably 0.1% by mass to 300% by mass and more preferably 3% by mass to 100% by mass relative to the reversible developer.

Meanwhile, the leuco dye and the reversible developer may be used as included in a microcapsule.

When the organic low-molecular material contains the leuco dye and the reversible developer, the reversible thermosensitive recording layer contains binder resin and cross-linking agent, etc. besides the above components and further contains other layers as necessary.

The binder resin is not particularly limited as long as it can bind the recording layer on the support and one, or two or more resins suitably selected from known resins may be mixed for use.

The binder resin is preferably a resin which can be hardened by heat, ultraviolet rays and electron rays in order to improve repetition durability and heat-curable resin using isocyanate compounds as cross-linking agents is particularly preferable.

Examples of the heat-curable resin include resins having groups which react with cross-linking agents such as hydroxyl group and carboxylic group, or resins of which monomers having hydrocarbon groups and carboxylic groups, etc. and other monomers are copolymerized. Specific examples of such heat-curable resins include phenoxy resin, polyvinyl butyral resin, cellulose acetate propionate resin, cellulose acetate butyrate resin, acrylpolyol resin, polyester polyol resin, polyurethane polyol resin, and the like. Of these, acrylpolyol resin, polyester polyol resin and polyurethane polyol resin are particularly preferable.

The acrylpolyol resin may be synthesized by using unsaturated monomer having (metha)acrylic acid ester monomer and carboxylic group, unsaturated monomer having hydroxyl group and other ethylene unsaturated monomers and according to known solution polymerization, suspension polymerization and emulsion polymerization, etc.

Examples of the unsaturated monomers having hydroxyl group include hydroxylethylacrylate (HEA), hydroxylpropylacrylate (HPA), 2-hydroxyethylmethacrylate (HEMA), 2-hydroxypropylmethacrylate (HPMA), 2-hydroxybutylmonoacrylate (2-HBA), 1,4-hydroxybutylmonoacrylate (1-HBA), and the like. Of these, 2-hydroxyethylmethacrylate is preferable because crack resistance and durability of coated film becomes appropriate when a monomer having primary hydroxyl group is used.

The mixing ratio (mass ratio) of the leuco dye and the binder resin in the recording layer is preferably 0.1 to 10 relative to the leuco dye, which is 1.

When the binder resin is less than 0.1, heat intensity of the recording layer may be deficient and when it is more than 10, color developing density may be degraded.

The cross-linking agent is not particularly limited and may be selected accordingly and examples include isocyanates, amino resins, phenol resins, amines, epoxy compounds, and the like. Of these, isocyanates are preferable and polyisocyanate compounds having plural numbers of isocyanate group are particularly preferable.

Examples of isocyanates include hexamethylene diisocyanate (HDI), tolylene diisocyanate (TDI), xylylene diisocyanate (XDI), or adduct type, burette type and isocyanurate type thereof by trimethylolpropane or blocked isocyanates.

The additive amount of the cross-linking agent relative to the binder resin is preferably 0.01 to 2 in a ratio of functional group of the cross-linking agent to the numbers of active groups contained in the binder resin.

When the ratio of functional group is less than 0.01, heat intensity may be deficient, and when it is more than 2, color developing and erasing properties may be adversely affected.

Furthermore, catalysts, which are used for this type of reaction, may be used as a cross-linking accelerator.

Examples of the cross-linking accelerator include third amines such as 1,4-diazabicyclo [2,2,2]octane and metal compounds such as organic tin compound.

Gel fraction of the heat-curable resin when thermally cross-linked is preferably 30% or more, more preferably 50% or more and most preferably 70% or more.

When the gel fraction is less than 30%, cross-linking condition is insufficient and durability may be degraded.

For example, it is possible to determine whether or not the binder resin is in cross-linking state or non-crosslinking state by dipping the coated film in a solvent of high solubility. More specifically, the binder resin in non-crosslinking state starts to melt in the solvent and will not be left in dissolved substance.

Other components in the recording layer include various additives for improving or controlling coating properties or color developing and erasing properties. Examples of these additives include surfactants, plasticizers, conductive agents, filling agents, antioxidants, light stabilizers, color stabilizers, color erasure accelerators, and the like.

Surfactants and plasticizers are used to make image forming easier.

The surfactants are not particularly limited and may be selected accordingly and examples include anion surfactants, cationic surfactants, non-ion surfactants, ampholytic surfactants, and the like.

The plasticizers are not particularly limited and may be selected accordingly and examples include ester phosphate, fatty acid ester, phthalate ester, diacid ester, glycol, polyester plasticizer, epoxy plasticizer, and the like.

The method for preparing the recording layer is not particularly limited and may be selected accordingly. Preferred examples include (1) a method in which the support is coated with a coating liquid for recording layer, in which the binder resin, the leuco dye and the reversible developer are dissolved and/or dispersed in a solvent, and the support is then cross-liked simultaneously as it is made into a sheet-like form by evaporation of the solvent, (2) a method in which the support is coated with a coating liquid for recording layer, in which only the binder resin is dissolved and leuco dye and the reversible developer are dispersed in a solvent and the support is then cross-liked simultaneously as it is made into a sheet-like form by evaporation of the solvent and (3) a method in which the binder resin, the leuco dye and the reversible developer are heated and fused to be mixed with each other without solvent and the mixture is cross-linked after being formed in a sheet-like form and cooled.

Meanwhile, in these methods, a thermoreversible recording medium can be formed into a sheet-like form without using the support. Moreover, each material of the coating liquid for recording layer may be dispersed in a solvent by means of a dispersing device, each material may be dispersed in a solvent independently and then mixed, or materials may be deposited by cooling rapidly or gradually after heating and dissolving.

The solvents used in the methods for preparing the recording layer (1) and (2) are not particularly limited and may be selected accordingly. It cannot be defined completely because it differs depending on the type of the binder resin, the leuco dye and the reversible developer, however, examples include tetrahydrofran, methyl ethyl ketone, methyl isobutyl ketone, chloroform, carbon tetrachloride, ethanol, toluene, benzene, and the like.

The reversible developer exists in the recording layer in form of dispersed particles.

In order for the coating liquid for the recording layer to exhibit high degree of performance as a coating liquid for coating material, various pigments, antifoaming agent, dispersing agent, slipping agent, antiseptic agent, cross-linking agent, plasticizer, etc. may be added to the coating liquid for the recording layer.

The method for coating the recording layer is not particularly limited and may be selected accordingly. The recording layer can be coated by transporting the support in form of sequencing roll or the support cut in a sheet form and by using known method such as blade coating, wire bar coating, spray coating, air knife coating, bead coating, curtain coating, gravure coating, kiss coating, reverse roll coating, dip coating, dye coating, and the like.

The drying condition of the coating liquid for recording layer is not particularly limited and may be selected accordingly and examples include approximately 10 seconds to 10 minutes at room temperatures to 140° C.

The thickness of the recording layer is not particularly limited and may be adjusted accordingly and it is preferably 1 μm to 20 μm and more preferably 3 μm to 15 μm, for example.

When the thickness of the recording layer is less than 1 μm, image contrast may be lowered due to the decrease in color developing density, and when it is more than 20 μm, heat distribution in the layer increases and the area where the temperature does not reach the color developing temperature and the color is not developed appears and desired color developing density may not be obtained.

—Protective Layer—

The protective layer is preferably disposed on the recording layer for the purpose of protecting the recording layer.

The protective layer is not particularly limited and may be selected accordingly and it may be formed into a multilayer, however, it is preferably disposed on an outermost surface of the exposed layer.

The protective layer contains at least a binder resin and further contains other components such as fillers, lubricants and coloring pigments accordingly.

The binder resin of the protective layer is not particularly limited and may be selected accordingly and preferred examples include ultraviolet-curable resin, heat-curable resin, electron beam-curable resin, and the like. Of these, ultraviolet-curable resin and heat-curable resin are particularly preferable.

Since the ultraviolet-curable resin can form very hard film after hardening and prevent surface damages by physical contact or deformation of mediums by laser heating, a thermoreversible recording medium of excellent repetition durability can be obtained.

Moreover, the heat-curable resin can harden the surface as similar to the ultraviolet-curable resin though it is somewhat inferior to the ultraviolet-curable resin, and a thermoreversible recording medium of excellent repetition durability can be obtained.

The ultraviolet-curable resin is not particularly limited and may be selected from known ultraviolet-curable resins accordingly. Examples include oligomers of urethane acrylate, epoxy acrylate, polyester acrylate, polyether acrylate, vinyl and unsaturated polyester; and monomers of various monofunctional or polyfunctional acrylate, methacrylate, vinyl ester, ethylene derivative, allyl compounds, and the like. Of these, polyfunctional monomers or oligomers of tetrafunctional or more are particularly preferable. By mixing 2 or more types of these monomers or oligomers, hardness, degree of shrinkage, flexibility, strength of coated film, etc. can be adjusted accordingly.

In order to harden the monomer or oligomer using ultraviolet rays, it is necessary to use photopolymerization initiator and photopolymerization accelerator.

The photopolymerization initiator can be classified broadly into radical reaction type and ion reaction type, and the radical reaction type can be further classified into photocleavable type and hydrogen abstraction type.

The photopolymerization initiator is not particularly limited and may be selected accordingly and examples include isobutylbenzoinether, isopropylbenzoinether, benzoinethylletherbenzoinmethylether, 1-phenyl-1,2-propanedion-2-(o-ethoxycarbonyl) oxime, 2,2-dimethoxy-2-phenylacetophenonebenzyl, hydroxycyclohexylphenylketone, diethoxyacetophenone, 2-hydroxy-2-methyl-1-phenylpropane-1-on, benzophenone, chlorothioxanthone, 2-chlorothioxanthone, isopropylthioxanthone, 2-methylthioxanthone, chlorine-substituted benzophenone, and the like. These may be used alone or in combination.

The photopolymerization accelerator is not particularly limited and may be selected accordingly. It is preferably the one having an effect of improving curing rate relative to the photopolymerization initiator of hydrogen abstraction type such as benzophenone, thioxanthone, etc. and examples include aromatic third amine or aliphatic amine. Specific examples include isoamyl p-dimethylamino benzoic ester, ethyl p-dimethylamino benzoic ester, and the like. These may be used alone or in combination.

The additive amounts of the photopolymerization initiator and the photopolymerization accelerator are not particularly limited and may be adjusted accordingly and it is preferably 0.1% by mass to 20% by mass and more preferably 1% by mass to 10% by mass relative to the whole amount of the resin component in the protective layer.

The ultraviolet irradiation for curing the ultraviolet-curable resin can be performed by means of known ultraviolet irradiation devices and examples of the ultraviolet irradiation device include the ones equipped with light source, lamp fitting, electric source, cooling device and carrier device, etc.

Examples of the light sources include mercury lamp, metal halide lamp, potassium lamp, mercury xenon lamp, flash lamp, and the like.

The wavelength of the light emitted from the light sources is not particularly limited and may be suitably selected according to the ultraviolet absorption wavelength of photopolymerization initiator and photopolymerization accelerator contained in the recording layer.

The irradiation condition of the ultraviolet light is not particularly limited and may be selected accordingly and lamp output and transportation rate may be suitably determined according to the irradiation energy required for cross-linking the resin, for example.

Moreover, for the purpose of ensuring appropriate conveying property, release agents such as silicon having polymerizable groups, silicon-grafted polymer, wax, zinc stearate, etc. and lubricants such as silicon oil, etc. may be added to the protective layer.

The additive amount of these additives are preferably 0.01% by mass to 50% by mass and more preferably 0.1% by mass to 40% by mass relative to the whole mass of the resin component in the protective layer.

Though it is possible to exhibit effect even with a small additive amount, if the additive amount is less than 0.01% by mass, effect due to addition may be difficult to obtain and if it is more than 50% by mass, a problem of adhesive property with lower layers may occur.

Furthermore, the protective layer may contain organic ultraviolet-absorbing agents and the content is preferably 0.5% by mass to 10% by mass relative to the whole mass of the resin component in the protective layer.

In addition, inorganic filler, organic filler, and the like may be added in order to improve conveying property.

Examples of the inorganic filler include calcium carbonate, kaolin, silica, aluminum hydroxide, alumina, aluminum silicate, magnesium hydroxide, magnesium carbonate, magnesium oxide, titanic oxide, zinc oxide, barium sulfate, talc, and the like. These may be used alone or in combination.

Moreover, it is preferable to use conductive filler as a countermeasure against static electricity and the conductive filler is more preferably needle-shaped.

Particularly, titanic oxide of which the surface is coated with antimony-doped tin oxide is preferable as the conductive filler.

The particle diameter of the inorganic filler is preferably 0.0 μm to 10.0 μm and more preferably 0.05 μm to 8.0 μm, for example.

The additive amount of the inorganic filler is preferably 0.001 part by mass to 2 parts by mass and more preferably 0.005 parts by mass to 1 part by mass relative to the 1 part by mass of binder resin in the protective layer.

Examples of the organic filler include silicon resin, cellulose resin, epoxy resin, nylon resin, phenol resin, polyurethane resin, urea resin, melamine resin, polyester resin, polycarbonate resin, styrene resin, acrylic resin, polyethylene resin, formaldehyde resin, polymethyl methacrylate resin, and the like.

It is preferable that the heat-curable resin is cross-liked. Therefore, the heat-curable resin is preferably having a group which reacts with curing agent such as hydroxyl group, amino group, carboxylic group, and the like, for example, and polymers having hydroxyl group are particularly preferable.

The heat-curable resin is preferably having a hydroxyl value of 10 or more, more preferably 30 or more and most preferably 40 or more in terms of sufficient coated-film strength in order to improve strength of the protective layer. By providing sufficient strength to the coated film, degradation of the thermoreversible recording medium can be suppressed even repetitive erasing and printing are performed.

Preferred examples of the curing agents include the one similar to the curing agents used for the recording layer.

Known surfactants, leveling agents, antistatic agents may be added to the protective layer as additives.

Furthermore, polymers having ultraviolet-absorbing structure (hereinafter may be referred to as "ultraviolet-absorbing polymer") may be used.

The polymer having the ultraviolet-absorbing structure is defined as a polymer having ultraviolet-absorbing structure (ultraviolet-absorbable group, for example) in the molecule.

Examples of the ultraviolet-absorbing structure include salicylate structure, cyanoacrylate structure, benzotriazole structure, benzophenone structure, and the like. Of these, benzotriazole structure and benzophenone structure are particularly preferable for appropriate light stability.

The polymers having the ultraviolet-absorbing structure are not particularly limited and may be selected accordingly and examples include copolymers of 2-(2'-hydroxy-5'-methacryloxyethylphenyl)-2H-benzotriazole, 2-hydroxyethyl methacrylate and styrene, copolymers of 2-(2'-hydroxy-5'-methylphenyl) benzotriazole, 2-hydroxypropyl methacrylate and methylmethacrylate, copolymers of 2-(2'-hydroxy-3'-t-butyl-5'-methylphenyl)-5-chlorobenzotriazole, 2-hydroxyethyl methacrylate, methyl methacrylate and t-butyl methacrylate, and copolymers of 2,2,4,4-tetrahydroxybenzophenone, 2-hydroxypropyl methacrylate, styrene, methyl methacrylate and propyl methacrylate. These may be used alone or in combination.

The known methods described for the preparation of the recording layer can be applied for solvent used for coating liquid for protective layer, dispersing device of coating liquid, method for coating and drying protective layers. When the ultraviolet-curable resin is used, curing step by ultraviolet irradiation becomes necessary after coating and drying and ultraviolet irradiation device, light source, irradiation condition, etc. are as described above.

The thickness of the protective layer is not particularly limited and may be adjusted accordingly and it is preferably 0.1 μm to 20 μm, more preferably 0.5 μm to 10 μm and most preferably 1.5 μm to 6 μm.

When the thickness is less than 0.1 μm, the function as a protective layer of the thermoreversible recording medium cannot be exhibited properly and degradation occurs quickly by repetitive history of heating and the protective layer may not be applicable for repetitive use. When the thickness is more than 20 μm, sufficient heat is not transmitted to the recording layer, which is a lower layer of the protective layer, and printing and erasing of images by heat may not be performed satisfactorily.

—Intermediate Layer—

The intermediate layer is preferably disposed between the recording layer and the protective layer, for the purposes of improving adhesion properties between the recording layer and the protective layer, preventing transformation of the recording layer by application of the protective layer and preventing transfer of the additives in the protective layer to the recording layer, etc. By this, storage property of the color-developed images may be improved.

The intermediate layer contains at least a binder resin and further contains other components such as filler, lubricant and coloring pigment accordingly.

The binder resin of the intermediate layer is not particularly limited and may be selected accordingly and resin components such as binder resin, thermoplastic resin and heat-curable resin may be used.

Examples of the binder resin include polyethylene, polypropylene, polystyrene, polyvinylalcohol, polyvinylbutyral, polyurethane, saturated polyester, unsaturated polyester, epoxy resin, phenol resin, polycarbonate, polyamide, and the like.

It is preferable for the intermediate layer to contain ultraviolet-absorbing agent.

The ultraviolet-absorbing agent is not particularly limited and may be selected accordingly and any one of organic compounds and inorganic compounds may be used, for example.

Examples of the organic compounds (organic ultraviolet-absorbing agent) include ultraviolet-absorbing agents of benzotriazole, benzophenone, salicylate ester, cyanoacrylate and cinnamate. Of these, ultraviolet-absorbing agent of benzotriazole is preferable.

Of benzotriazole, the one protected with bulky functional groups which lie next to hydroxyl groups is particularly preferable, and preferred examples include 2-(2'-hydroxy-3',5'-di-t-butylphenyl) benzotriazole, 2-(2'-hydroxy-3'-t-butyl-5'-methylphenyl) benzotriazole, 2-(2'-hydroxy-3',5'-di-t-butylphenyl)-5-chlorobenzotriazole and 2-(2'-hydroxy-3'-t-butyl-5'-methylphenyl)-5-chlorobenzotriazole. Furthermore, skeletons having an ultraviolet absorbing function may be pendanted with copolymerized polymers such as acrylic resin and styrene resin.

The content of the organic ultraviolet-absorbing agent is preferably 0.5% by mass to 10% by mass relative to the whole amount of the resin component in the intermediate layer, for example.

The inorganic compounds (inorganic ultraviolet-absorbing agent) are preferably metal compounds having an average particle diameter of 100 nm or less and examples include metal oxides such as zinc oxide, indium oxide, alumina, silica, zirconia oxide, tin oxide, cerium oxide, iron oxide, antimony oxide, barium oxide, calcium oxide, bismuth oxide, nickel oxide, magnesium oxide, chrome oxide, manganese oxide, tantalum oxide, niobium oxide, thorium oxide, hafnium oxide, molybdenum oxide, ferrous ferrite, nickel ferrite, cobalt ferrite, barium titanate and potassium titanate or compound oxides thereof; metal sulfides such as zinc sulfide and barium sulfide or sulfated compounds thereof; metal carbides such as titanium carbide, silicon carbide, molybdenum carbide, tungsten carbide and tantalum carbide; metal nitrides such as aluminum nitride, silicon nitride, boron nitride, zirconium nitride, vanadium nitride, titanium nitride, niobium nitride and gallium nitride. Of these, ultrafine particles of metal oxides are preferable and silica, alumina, zinc oxide, titanium oxide and cerium oxide are more preferable. Meanwhile, surfaces of these metal compounds may be processed with silicon, wax, organic silane or silica.

The content of the inorganic ultraviolet absorbing agent is preferably 1% to 95% in volume fraction.

The organic and inorganic ultraviolet-absorbing agents may be contained in the recording layer.

Moreover, ultraviolet-absorbing polymers may be used or curing may be induced by cross-linking agents. Similar agents as used in the protective layers may suitably be used.

The thickness of the intermediate layer is not particularly limited and may be adjusted accordingly and it is preferably 0.1 μm to 20 μm and more preferably 0.5 μm to 5 μm.

The known methods described for the preparation of the recording layer can be applied for solvent used for coating liquid of intermediate layer, dispersing device of coating liquid, method for coating the intermediate layer and method for drying and curing intermediate layer.

—Under Layer—

An under layer may be disposed between the recording layer and the support for the purposes of improving adhesion properties between the support and the recording layer and preventing interfusion of the recording layer material to the support in order to achieve higher sensitivity by effectively using the applied heat.

The under layer contains at least empty particles and a binder resin, and further contains other components as necessary.

Examples of the empty particles include single empty particles in which one empty portion exists in the particle and multiple empty particles in which a lot of empty portions exist in the particle. These may be used alone or in combination.

Materials of the empty particles are not particularly limited and may be selected accordingly and preferred examples include thermoplastic resin.

The empty particles may be manufactured properly or of commercialized product. Examples of the commercialized product include Microsphere R-300 (by Matsumoto Yushi-Seiyaku Co., Ltd.), Lopake HP1055 and Lopake HP433J (by Zeon Corp) and SX866 (by JSR Corp).

The additive amount of the empty particles in the under layer is not particularly limited and may be adjusted accordingly and it is preferably 10% by mass to 80% by mass, for example.

The resin similar to the one used for the recording layer or the layer containing a polymer having the ultraviolet-absorbing structure may be used as the binder resin of the under layer.

At least any one of inorganic fillers such as calcium carbonate, magnesium carbonate, titanium oxide, silicon oxide, aluminum hydroxide, kaolin, talc, and the like and organic fillers may be contained in the under layer.

Other additives such as lubricant, surfactant, dispersing agent, and the like may be contained in the under layer.

The thickness of the under layer is not particularly limited and may be adjusted accordingly and it is preferably 0.1 μm to 50 μm, more preferably 2 μm to 30 μm and most preferably 12 μm to 24 μm.

—Back Layer—

Back layers may be disposed on the side of the support which is opposite of the side on which the recording layer is disposed for preventing curl or charging of the thermoreversible recording medium and improving conveying property.

The back layer contains at least a binder resin, and further contains other components such as filler, conductive filler, lubricant and coloring pigment as necessary.

The binder resin of the back layer is not particularly limited and may be selected accordingly and examples include heat-curable resin, ultraviolet-curable resin, electron beam-curable resin, and the like. Of these, ultraviolet-curable resin and heat-curable resin are particularly preferable.

The similar resins used for the recording layer, protective layer and the intermediate layer may suitably be used as the ultraviolet-curable resin and the heat-curable resin. Moreover, it is the same for fillers, conductive fillers and lubricants.

—Photothermal Conversion Layer—

The photothermal conversion layer has a function to absorb laser beams and generate heat.

The photothermal conversion layer contains at least photothermal conversion material which functions to absorb laser beams and generate heat.

The photothermal conversion layer can be classified broadly into inorganic material and organic material.

Examples of the inorganic materials include carbon black, or metals such as Ge, Bi, In, Te, Se and Cr, etc. and semimetals or alloys containing thereof and these are formed into a layer by vacuum evaporation or bonding the material in form of particle with resin, etc.

Various dyes may suitably be used as the organic material according to the light wavelength to be absorbed and when laser diode is used as a light source, near-infrared absorbing dye having an absorption peak at near 700 nm to 1,500 nm. Specific examples include cyanine dye, quinine dye, quinoline derivative of indonaphthol, phenylenediamine-based nickel complex and phthalocyanine dye. It is preferable to select photothermal conversion material which excels in heat resistance for performing repetitive printing and erasing.

The near-infrared absorbing dye may be used alone or in combination and it can be mixed in the recording layer. By mixing the near-infrared absorbing dye, the recording layer also serves as the photothermal conversion layer.

When the photothermal conversion layer is disposed, the photothermal conversion material is normally used with the resin layer simultaneously. The resin used for the photothermal conversion layer is not particularly limited and may be selected from known resins accordingly as long as it is capable of retaining the inorganic material and organic material and it is preferably thermoplastic resin and heat-curable resin.

—Adhesion Layer and Sticking Layer—

The thermoreversible recording medium can be obtained in the aspect of thermoreversible recording label by disposing adhesive layer or sticking layer on the side of the support which is opposite of the side on which the recording layer is formed.

The materials for the adhesive layer and the sticking layer are not particularly limited and may be selected from materials commonly used accordingly and examples include urea resin, melamine resin, phenol resin, epoxy resin, vinyl acetate resin, vinyl acetate-acrylic copolymer, ethylene-vinyl acetate copolymer, acrylic resin, polyvinylether resin, vinyl chloride-vinyl acetate copolymer, polystyrene resin, polyester resin, polyurethane resin, polyamide resin, chlorinated polyolefin resin, polyvinyl butyral resin, acrylic acid ester copolymer, methacrylic acid ester copolymer, natural rubber, cyanoacrylate resin, silicon resin, and the like.

The materials for the adhesive layer and the sticking layer may be of hot-melt type. Release paper may also be used or it may be of non-release paper type. By disposing the adhesive layer or the sticking layer as such, the recording layer can be sticked to the entire surface or part of the thick substrate such as vinyl chloride card with magnetic stripes to which applying recording layer is difficult. And this improves convenience of the thermoreversible recording medium such as the ability to display part of the magnetically stored information.

The thermoreversible recording label to which such adhesive layer or sticking layer is disposed is suitable for thick cards such as IC card, optical card, and the like.

—Coloring Layer—

A coloring layer may be disposed between the support and the recording layer of the thermoreversible recording medium for the purpose of improving visibility.

The coloring layer may be formed by applying solutions or dispersion liquid containing coloring agents and resin binders on targeted surface and then drying, or by simply sticking the coloring sheet.

The coloring layer may be a color printing layer.

The coloring agent in the color printing layer includes various dyes and pigments contained in color inks used for existing full-color printing.

Examples of the resin binder include various thermoplastic resins, heat-curable resins, ultraviolet-curable resins or electron beam-curable resins.

The thickness of the color printing layer is not particularly limited and because it may be changed properly depending on the printing color density, the thickness may be selected according to the desired printing color density.

The thermoreversible recording medium may have non-reversible recording layer simultaneously. The developed color tone of each recording layer may be identical or different.

Furthermore, coloring layers on which arbitrary pictures are formed by printing such as offset printing and gravure printing or by inkjet printers, thermoelectric printers and dye sublimation printers on part or entire surface of the same side or part of the opposite side of the recording layer in the thermoreversible recording medium. Furthermore, OP varnish layer, which contains a curable resin as a main component, may be disposed on part or entire surface of the coloring layer.

Examples of pictures include characters, patterns, drawing patterns, photographs and information detected by infrared rays.

Moreover, any of composing layers may be colored by simply adding dyes or pigments.

Furthermore, holograms may be disposed on the thermoreversible recording medium for security purposes. And designs such as figures, company symbols and symbol marks, etc. may be disposed by making concavity and convexity in relief form or intaglio form for provision of industrial design.

—Form and Use of Thermoreversible Recording Medium—

The thermoreversible recording medium can be formed into desired form accordingly and may be formed into card form, tag form, label form, sheet form and roll form, for example.

The thermoreversible recording medium formed into card form can be applied to prepaid cards and point cards, etc. and can be further applied to credit cards.

In addition, the thermoreversible recording medium in tag form, which is smaller than card form, can be applied to price tags, etc. and the thermoreversible recording medium in tag form, which is larger than card form, may be applied to process management, shipping instruction and ticket, etc.

The thermoreversible recording medium in label form may be processed to have various sizes and used for process management or material management, etc. by sticking to trucks, containers, boxes and bulk containers, etc. which are used repeatedly. Moreover, because the thermoreversible recording medium of sheet size, which is larger than card size, allows wider print range, it is usable for general documents or instructions for process management.

—Example of Combination with Thermoreversible Recording Member RF-ID—

With the thermoreversible recording member, information can be checked by looking at cards or tags without use of special devices, providing excellent convenience because the reversible thermosensitive recording layer (recording layer) which is reversibly displayable and information memory unit are disposed on identical cards or tags (integrated) and a part of stored information in the information memory unit is displayed on the recording layer. When the content of the information memory unit is overwritten, the thermoreversible recording medium can be reused repeatedly by overwriting the display of the thermoreversible recording unit.

The information memory unit is not particularly limited and may be selected accordingly and preferred examples include magnetic recording layer, magnetic stripe, IC memory, optical memory, RF-ID tag, and the like. When the information memory unit is used for process management and material management, RF-ID tag is particularly suitable for use.

Meanwhile, the RF-ID tag is composed of IC chip and antenna connected to the IC chip.

The thermoreversible recording member has the reversibly displayable recording layer and information memory unit and preferred example of the information memory unit is RF-ID tag.

Figure 5:
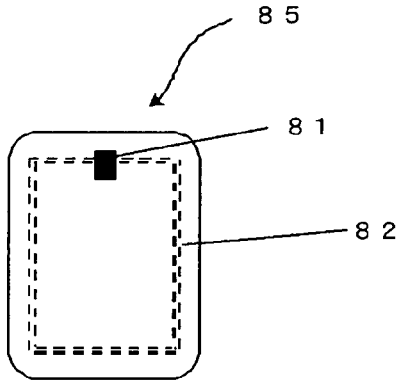
FIG. 5 is a schematic diagram showing an exemplary RF-ID tag.

FIG. 5 shows a schematic diagram of RF-ID tag. The RF-ID tag 85 is composed of an IC chip 81 and an antenna 82 connected to the IC chip 81. The IC chip 81 is divided into 4 sections: memory unit, power adjusting unit, transmission unit and reception unit, and each bears part of operation to communicate. The antennas of RF-ID tag 85 and reader/writer exchange data by communicating with radiowaves. Specifically, there are two types of communication, electromagnetic guidance system in which the antenna of RF-ID 85 receives radiowave from reader/writer and electromotive force is generated by electromagnetic guidance through resonant effect and radiowave system which is activated by radiated electromagnetic field. In either system, the IC chip 81 in the RF-ID tag 85 is activated by electromagnetic field from outside, information in the chip is made into a signal and then the signal is transmitted from the RF-ID tag 85. The information is received by the antenna of reader/writer, recognized by a data processing device and processed by softwares.

The RF-ID tag is formed into label form or card form and the RF-ID tag can be placed to the thermoreversible recording medium. The RF-ID tag can be placed on the surface of the recording layer or the back layer and it is preferably placed on the surface of the back layer.

The known adhesives or sticking agents may be used for bonding the RF-ID tag and the thermoreversible recording medium.

Moreover, the thermoreversible recording medium and the RF-ID tag may be integrated by lamination, etc. to be formed into card form or tag form.

An exemplary use of the thermoreversible recording member, a combination of the thermoreversible recording medium and the RF-ID tag in the process management will be described. The process line in which containers containing delivered raw materials are conveyed has a unit by which visible image is written on the display unit without contact while being conveyed and a unit by which visible image is erased without contact and in addition, it has a reader/writer for performing reading and overwriting of information of built-in RF-ID in the container by transmission of electromagnetic waves without contact. Furthermore, the process line also has a control unit which performs branching, measurement and management on the physical distribution line automatically by using the individual information which are read and written without contact while containers are conveyed.

Inspection is performed by recording information such as product name and quantity on the thermoreversible recording medium and the RF-ID tag of the thermoreversible recording medium with RF-ID placed on the container. In the next process, processing instruction is provided to the delivered raw material, information is recorded on the thermoreversible recording medium and the RF-ID tag to be a processing instruction for proceeding to the processing process. Next, order information is recorded on the thermoreversible recording medium and the RF-ID tag as an order instruction for the processed product, shipping information is read from collected containers after product shipment and containers and the thermoreversible recording medium with the RF-ID tag are used again for delivery.

At this time, erasing/printing of information can be performed without peeling the thermoreversible recording medium off from the containers, etc. because of non-contact recording on the thermoreversible recording medium by use of lasers. Furthermore, process can be managed in real time and information stored in the RF-ID tag can be displayed on the thermoreversible recording medium simultaneously because information can also be recorded on the RF-ID tag without contact.

(Image Processing Apparatus)

The image processing apparatus of the present invention is used for the method for image processing of the present invention and contains at least a laser beam irradiation unit and a light irradiation intensity adjusting unit, and further contains other members suitably selected as necessary.

—Laser Beam Irradiation Unit—

The laser beam irradiation unit is not particularly limited as long as it is capable of irradiating laser beams and may be selected accordingly and examples include normally used lasers such as $CO_2$ laser, YAG laser, fiber laser and laser diode (LD).

The wavelength of the laser beam irradiated from the laser beam irradiation unit is not particularly limited and may be adjusted accordingly and it is preferably in visible region to infrared region and more preferably in near-infrared region to far-infrared region for improving image contrast.

In the visible region, contrast may be degraded because additives for absorbing laser beam to generate heat is colored due to image forming and erasing of the thermoreversible recording medium.

The wavelength of the laser beam irradiated from the $CO_2$ laser is 10.6 μm in far-infrared region and because the thermoreversible recording medium absorbs the laser beam, adding additives for absorbing laser beam to generate heat for image forming and erasing on the thermoreversible recording medium becomes unnecessary. Moreover, because the additives may also absorb visible light though somewhat, even when a laser beam having a wavelength of near-infrared region is used, the $CO_2$ laser which does not require additives is advantageous in being able to prevent degradation of image contrast.

Since wavelength of the laser beam irradiated from YAG laser, fiber laser and laser diode is in visible region to near-infrared region (several hundred μm to 1.2 μm) and current thermoreversible recording medium does not absorb laser beam of the above wavelength region, it becomes necessary to add photothermal conversion material for absorbing and conversing laser beam to heat, however, it has an advantage of being able to form high-resolution images due to short wavelength.

Moreover, since YAG laser and fiber laser are of high power, it is advantageous in being able to accelerate image forming and erasing rates. Since laser diode itself is small in size, it is advantageous for downsizing of apparatus and furthermore, for reducing prices.

—Light Irradiation Intensity Adjusting Unit—

The light irradiation intensity adjusting unit has a function to change the light irradiation intensity of the laser beam.

The aspect of disposal for the light irradiation intensity adjusting unit is not particularly limited as long as it is disposed on the irradiation side of the laser beam of the laser beam irradiation unit, and the distance between the light irradiation intensity adjusting unit and the laser beam irradiation unit can be suitably selected accordingly.

The light irradiation intensity adjusting unit preferably has a function to change the light irradiation intensity in a way so that the light irradiation intensity of the center is equal to or less than the light irradiation intensity of the periphery in the light intensity distribution of cross-section in a direction approximately perpendicular to the traveling direction of the laser beam. The degradation of the thermoreversible recording medium due to repetitive forming and erasing of images can be suppressed and repetition durability can be improved while retaining image contrast.

Meanwhile, the detail of the relation between the light irradiation intensity of the center and the light irradiation intensity of the periphery in the light intensity distribution of cross-section in a direction approximately perpendicular to the traveling direction of the laser beam is as described above.

The light irradiation intensity adjusting unit is not particularly limited and may be selected accordingly and preferred examples include lens, filter, mask and mirror. Specifically, kaleidoscope, integrator, beam homogenizer and aspheric beam shaper (a combination of intensity transformation lens and phase correction lens) may be suitably used for example, and light irradiation intensity can be adjusted by physically cutting the center of the laser beam with filter and mask, etc.

And when the mirror is used, light irradiation intensity can be adjusted by using a deformable mirror of which the shape can be changed mechanically in conjunction with computers or a mirror in which reflectance or surface irregularity partially differs.

Furthermore, it is possible to change the light irradiation intensity of the center to become equivalent to or less than the light irradiation intensity of the periphery by adjusting the distance between the thermoreversible recording medium and fθ lens. In other words, as the distance between the thermoreversible recording medium and fθ lens is displaced from the focal distance, light intensity distribution in cross-section in a direction approximately perpendicular to the traveling direction of the laser beam can be changed from Gaussian distribution to the distribution in which the light intensity distribution of the center is lowered.

In addition, adjustment of light irradiation intensity can be easily performed by fiber coupling of laser diode, YAG laser, and the like.

An exemplary method for adjusting light irradiation intensity using aspheric beam shaper as the light irradiation intensity adjusting unit will be described below.

Figure 6A:
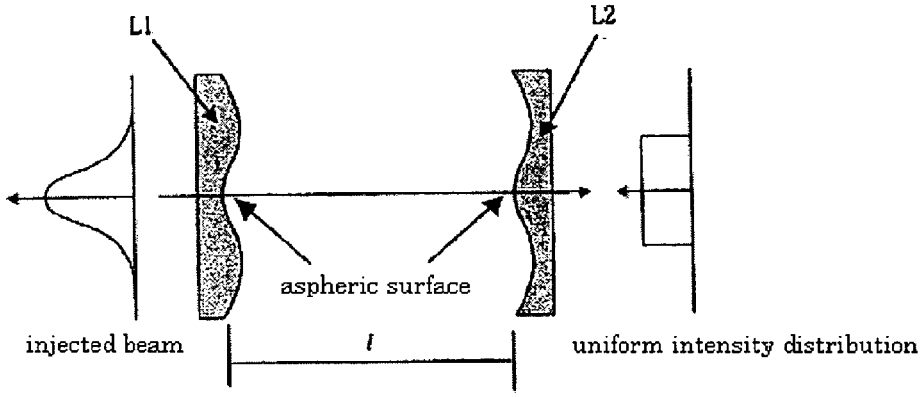
FIG. 6A is a schematic diagram showing an exemplary light irradiation intensity adjusting unit of the image processing apparatus of the present invention.

When a combination of intensity transformation lens and phase correction lens is used for example, 2 aspheric lenses are arranged on the light path of the laser beam irradiated from the laser beam irradiation unit as shown in FIG. 6A. The intensity is then transformed by a first aspheric lens L1 at a targeted position (distance 1) so as to make light irradiation intensity of the center to be equivalent to or less than (flat top shape in FIG. 6A) the light irradiation intensity of the periphery in the light intensity distribution. The phase correction is performed by a second aspheric lens L2 for parallel propagation of the intensity-transformed laser beam. As a result, light intensity distribution, which is a Gaussian distribution, can be changed.

Figure 6B:
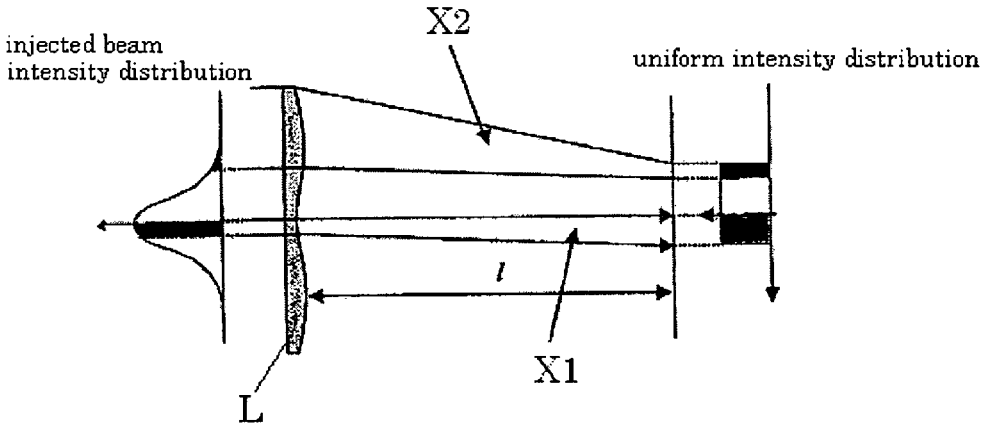
FIG. 6B is a schematic diagram showing an exemplary light irradiation intensity adjusting unit of the image processing apparatus of the present invention.

Furthermore, only intensity transformation lens L may be arranged on the light path of the laser beam irradiated from the laser beam irradiation unit as shown in FIG. 6B. In this case, the light irradiation intensity of the center can be transformed so as to be equivalent to or less than (flat top shape in FIG. 6B) the light irradiation intensity of the periphery in the light intensity distribution by scattering the incoming laser beam of Gaussian distribution in an area (inside) where intensity is high as shown by arrow X1 and by focusing the incoming laser beam in an area (outside) where intensity is low as shown by arrow X2.

Furthermore, an exemplary method for adjusting light irradiation intensity by combination of fiber coupled laser diode and lens as the light irradiation intensity adjusting unit will be described below.

With a fiber coupled laser diode, the light intensity distribution of the laser beam irradiated from the fiber end differs from the Gaussian distribution and becomes a light intensity distribution which corresponds to the middle of the Gaussian distribution and the flat-top shape because laser beams are transmitted while repeating reflecting in the fiber. In order to make the above light intensity distribution to be the flat-top shape, a combination of plural numbers of convex lenses and/or concave lenses is attached to the fiber end as a focusing optical system. And when a distance from the laser beam source to the thermoreversible recording medium is a focal length, the flat-top shape can be obtained, however, when the distance is slightly off the focal length, obtainable light intensity distribution of the laser beam is the Gaussian distribution and furthermore, when the distance significantly differs from the focal length, the light intensity distribution becomes such that the light irradiation intensity of the center is smaller than the light irradiation intensity of the periphery as shown in FIG. 1D. The light irradiation intensity of the center at this time can be easily adjusted by changing the distance from the laser beam source to the thermoreversible recording medium.

The basic composition of the image processing apparatus of the present invention is similar to the one normally called laser marker and it is equipped with at least a transmission unit, a power control unit and a program unit besides having at least the laser beam irradiation unit and the light intensity adjusting unit.

Figure 7:
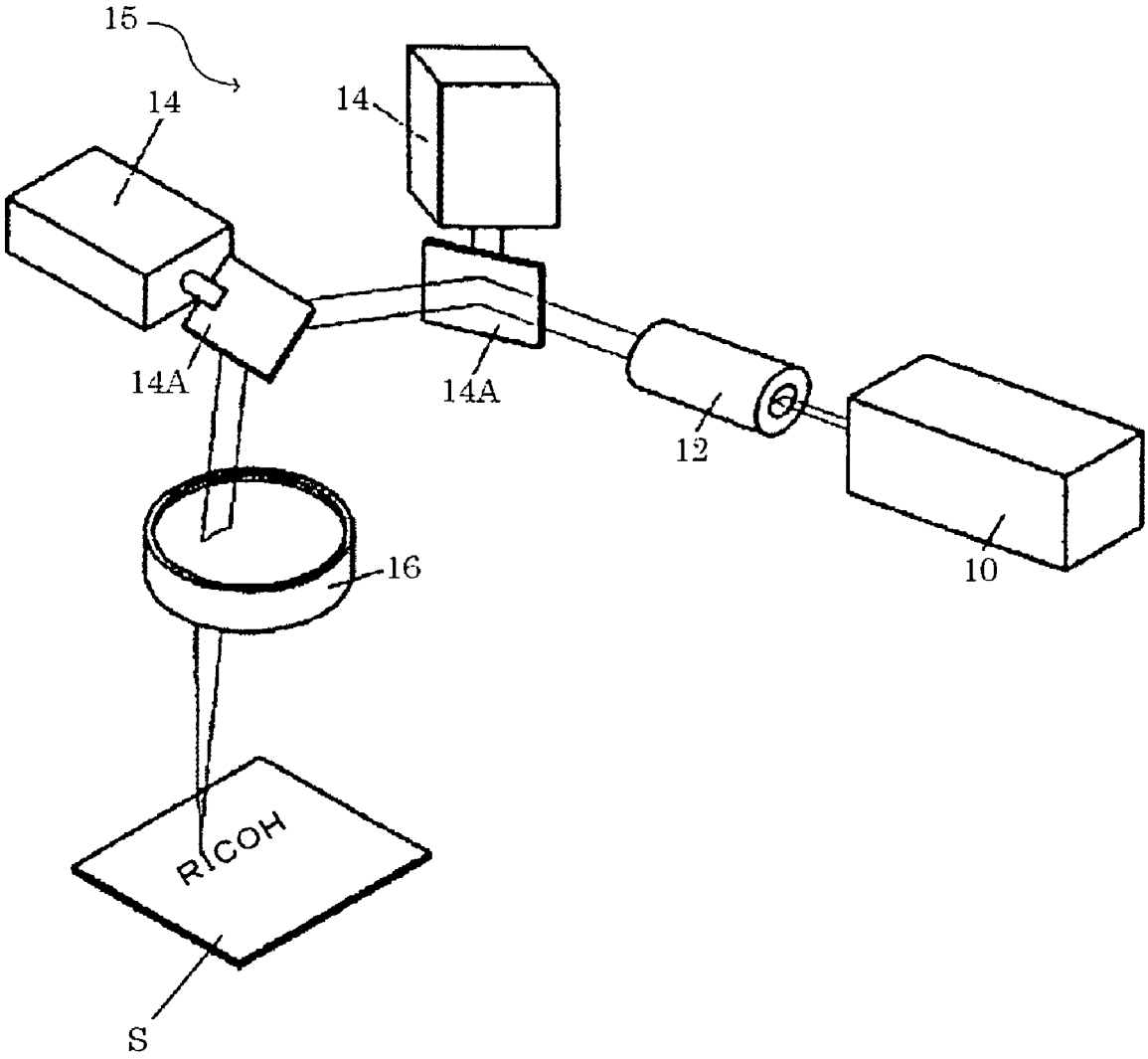
FIG. 7 is a schematic diagram showing an exemplary image processing apparatus of the present invention.

An exemplary image processing apparatus of the present invention is shown in FIG. 7 with a primary focus on the laser irradiation unit.

In the image processing apparatus as shown in FIG. 7, a mask (not shown) which cut the center of the laser beam as the light irradiation intensity adjusting unit is set in the light path of a laser marker having $CO_2$ laser with an output power of 40 W (LP-440 by SUNX Limited) so as to make it possible to adjust the light intensity distribution of orthogonal cross-section to the traveling direction of the laser beam in a way so that the light irradiation intensity of the center is changed relative to the light irradiation intensity of the periphery.

The specification of the laser irradiation unit, head part for image recording/erasing is as follow:

Possible laser output: 0.1 W to 40 W
Movable irradiation distance: no limit
Spot diameter: 0.18 mm to 10 mm
Scan speed: max. 12,000 mm/s
Irradiation Distance: 110 mm×110 mm
Focus distance: 185 mm The transmission unit is composed of a laser transmitter 10, a beam expander 12, a scanning unit 15 and a fθ lens 16, etc.

The laser transmitter 10 has high light intensity and it is needed for obtaining a laser beam of high directivity. For example, mirrors are placed on both sides of the laser medium, the laser medium is pumped (supplied with energy) to induce emission by increasing the number of atoms in excited state and forming population inversion. Only light in a light axis direction is selectively amplified, thereby increasing directivity of light to emit the laser beam from the output mirror.

The scanning unit 15 is composed of a galvanometer 14 and a mirror 14A fixed to the galvanometer 14. The laser beam irradiated from the laser transmitter 10 is scanned while rotated at high speed by means of two mirrors 14A in X axis direction and Y axis direction which are attached to the galvanometer 14 to perform image forming and erasing on a thermoreversible recording medium S.

The fθ lens 16 is a lens which makes the laser beam rotated and scanned at an equiangular speed by the mirror 14A attached to the galvanometer 14 to move uniformly on a plane surface of the thermoreversible recording medium.

The power control unit is composed of a power source for electric discharge (in the case of $CO_2$ laser) or a drive power source (YAG laser, etc.) of the light source which excites laser medium, power sources for cooling down such as drive power source for galvanometer and Peltier-element, etc. and control unit which controls the image processing apparatus as a whole.

The program unit is a unit which enters conditions such as laser beam intensity and laser scanning speed, etc. or performs forming and editing of recorded characters, etc. by touch panel input or key board input for image forming and erasing.

The image processing apparatus is equipped with the laser irradiation unit, the heat part for image recording/erasing and the image processing apparatus is also equipped with a conveying unit for the thermoreversible recording medium and its control unit and monitor unit (touch panel), etc.

The images of high contrast can be formed and erased repeatedly at high speeds on the thermoreversible recording mediums such as labels placed on containers such as cardboards without contact and the degradation of the thermoreversible recording medium by repetition can be suppressed by the method for image processing and the image processing apparatus of the present invention. Therefore, it is particularly suitable for use in physical distribution/delivery systems. In this case, for example, images can be formed or erased on the label while cardboards on the belt conveyer are being conveyed, thereby shortening the shipment time because there is no need to stop the line. Moreover, the cardboard on which the label has been placed can be reused as it is without peeling off the label to perform image erasing and recording again.

Furthermore, degradation of the thermal reversible recording medium due to repetitive forming and erasing of images can be effectively suppressed because the image processing apparatus has the light irradiation intensity adjusting unit which changes the light irradiation intensity of the laser beam.

EXAMPLES

The invention will be explained in detail referring to Examples and Comparative Examples below, however, the following Examples and Comparative Examples should not be construed as limiting the scope of this invention.

Example 1

Example 1 is an example corresponding to the first aspect of the method for image processing of the present invention.

<Preparation of Thermoreversible Recording Medium>

A thermoreversible recording medium in which color tone changes reversibly (between clear state and color developing state) depending on temperatures was prepared as follow.

—Support—

A milky polyester film (Tetron Film U2L98W by Teijin Dupont Films Japan Limited) of 125 μm thickness was used as a support.

—Under Layer—

A coating liquid for under layer was prepared by adding 30 parts by mass of styrene-butadiene copolymer (PA-9159 by Nippon A&L Inc.), 12 parts by mass of polyvinyl alcohol resin (Poval PVA103 by Kuraray Co., Ltd.), 20 parts by mass of empty particle (Microsphere R-300 by Matsumoto Yushi-Seiyaku Co., Ltd.) and 40 parts by mass of water to mix for approximately one hour until it is mixed uniformly.

Next, the support was coated with the obtained coating liquid for under layer by means of a wire bar, heated at 80° C. for 2 minutes and dried to form an under layer of 20 μm thickness.

—Reversible Thermosensitive Recording Layer (Recording Layer)—

5 parts by mass of the reversible developer expressed by the following Structural Formula (1), 0.5 parts by mass each of 2 types of the color erasure accelerators expressed by the following Structural Formulas (2) and (3), 10 parts by mass of 50% by mass solution of acrylpolyol (hydroxyl value: 200) and 80 parts by mass of methyl ethyl ketone are pulverized and dispersed using a ball mill until an average particle diameter becomes approximately 1 μm.

(Reversible Developer)

Structural Formula 1

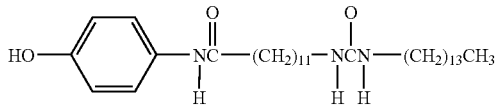

(Color Erasure Accelerator)

Structural Formula 2

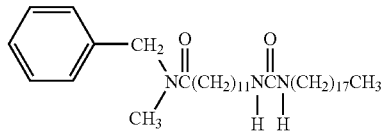

$C_{17}H_{35}CONHC_{18}H_{35}$ Structural Formula 3

Next, 1 part by mass of 2-anilino-3-methyl-6dibutylaminofluoran as a leuco dye, 0.2 parts by mass of phenol antioxidant (IRGANOX565 by Ciba Specialty Chemicals K.K.) expressed by the following Structural Formula (4), 0.03 parts by mass of photothermal conversion material (Excolor®IR-14 by Nippon Shokubai Co., Ltd.) and 5 parts by mass of isocyanate (Colonate HL by Nippon Plyurethane Industry Co., Ltd.) are added to the dispersion liquid in which the reversible developer is pulverized and dispersed and mixed well to prepare a coating liquid for recording layer.

Structural Formula 4

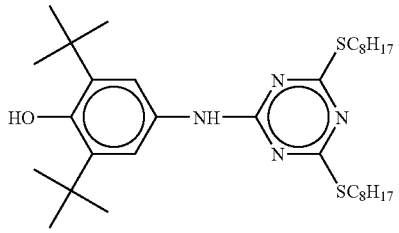

Next, the support, on which the under layer has already been formed, was coated with the obtained coating liquid for recording layer by means of a wire bar and curing was performed at 60° C. for 24 hours after drying at 100° C. for 2 minutes to form a recording layer of approximately 11 μm thickness.

—Intermediate Layer—

3 parts by mass of 50% by mass solution of acrylpolyol resin (LR327 by Mitsubishi Rayon Co., Ltd.), 7 parts by mass of 30% by mass dispersion liquid of zinc oxide particle (ZS303 by Sumitomo Osaka Cement Co., Ltd.), 1.5 parts by mass of isocyanate (Colonate HL by Nippon Polyurethane Industry Co., Ltd.) and 7 parts by mass of methyl ethyl ketone are added and mixed well to prepare a coating liquid for intermediate layer.

Next, the support, on which the under layer and the recording layer have already been formed, was coated with the coating liquid for intermediate layer by means of a wire bar, heated at 90° C. for 1 minute, dried and then heated at 60° C. for 2 hours to form an intermediate layer of approximately 2 μm thickness.

—Protective Layer—

3 parts by mass of pentaerythritolhexaacrylate (KAYARAD DPHA by Nippon Kayaku Co., Ltd.), 3 parts by mass of urethanacrylateoligomer (Art Resin UN-3320HA by Negami Chemical Industrial Co., Ltd.), 3 parts by mass of acrylic acid ester of pentaerythritolcaprolactone (KAYARAD DPCA-120 by Nippon Kayaku Co., Ltd.), 1 part by mass of silica (P526 by Mizusawa Industrial Chemical, Ltd.), 0.5 parts by mass of photopolymerization initiator (Irgacure® 184 by Nihon Ciba-Geigy K.K.) and 11 parts by mass of isopropyl alcohol were added and mixed well by means of a ball mill to disperse until an average particle diameter becomes approximately 3 μm to prepare a coating liquid for protective layer.

Next, the support, on which the under layer, the recording layer and the intermediate layer have already been formed, was coated with the coating liquid for protective layer by means of a wire bar, heated at 90° C. for 1 minute, dried and cross-liked by means of an ultraviolet lamp of 80 W/cm to form a protective layer of approximately 4 μm thickness.

—Back Layer—

7.5 parts by mass of pentaerythritolhexaacrylate (KAYARAD DPHA by Nippon Kayaku Co., Ltd.), 2.5 parts by mass of urethaneacrylateoligomer (Art Resin UN-3320HA by Negami Chemical Industrial Co., Ltd.), 2.5 parts by mass of needle-shaped conductive titanium oxide (FT-3000 by Ishihara Sangyo Kaisha, Ltd., long axis=5.15 μm, short axis=0.27 μm, composition: titanium oxide coated with antimony-doped tin oxide), 0.5 parts by mass of photopolymerization initiator (Irgacure 184 by Nippon Ciba-Geigy K.K.) and 13 parts by mass of isopropyl alcohol were added and mixed well by means of a ball mill to prepare a coating liquid for back layer.

Next, a surface of the support, on which the recording layer, the intermediate layer and the protective layer have already been formed, of the side where no layers as described above are formed was coated with the coating liquid for back layer by means of a wire bar, heated at 90° C. for 1 minute, dried and cross-linked by means of an ultraviolet lamp of 80 W/cm to form a back layer of approximately 4 μm thickness.

A thermoreversible recording medium was prepared as described above.

<Image Forming Step>

As a laser, a fiber coupling type, high-output semiconductor laser apparatus (NBT-S140mkII by Jenoptik Laserdiode, center wavelength: 808 nm, optical fiber core diameter: 600 μm, NA: 0.22) of 140 W, which is equipped with a focusing optical system f100 was used, and it was adjusted to have a laser output of 12 W, an irradiation distance of 91.4 mm and a spot diameter of approximately 0.6 mm. A laser beam was irradiated to the thermoreversible recording medium at a XY stage feed rate of 1,200 mm/s to form a linear image.

Figure 8:
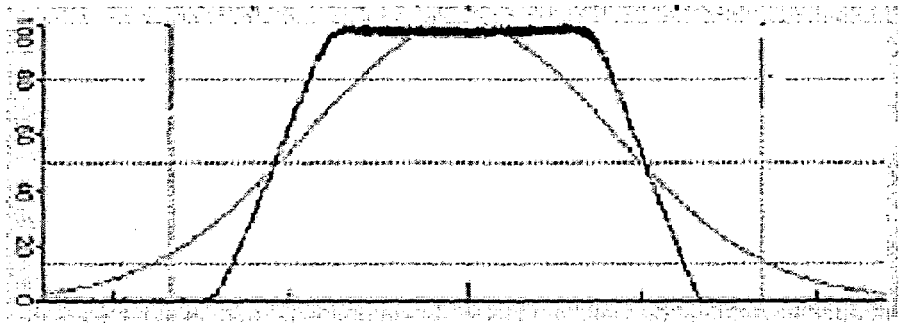
FIG. 8 is a schematic diagram showing the light intensity distribution of orthogonal cross-section to a traveling direction of the laser beam used in the image forming step of Example 1.

At this time, five ND filters (NG10 by Duma Optronics Ltd.) were used for light extinction to adjust the laser output to be 0.01% or less. When a light intensity distribution of cross-section in a direction approximately perpendicular to the traveling direction of the laser beam was measured by using a laser beam profiler, BeamOn (by Duma Optronics Ltd.), a light intensity distribution curve as shown in FIG. 8 was obtained. Moreover, the differentiation curve, the light intensity distribution curve which has been differentiated once (X') and twice (X"), is shown in FIG. 1B, and from these figures it turns out that the light irradiation intensity of the center is 1.05 times of the light irradiation intensity of the periphery.

<Image Erasing Step>

The linear image formed on the thermoreversible recording medium was erased by using the laser apparatus, which is adjusted to have a laser output of 15 W, an irradiation distance of 86 mm and a spot diameter of 3.0 mm, at a XY stage feed rate of 1,200 mm/s.

Figure 10:
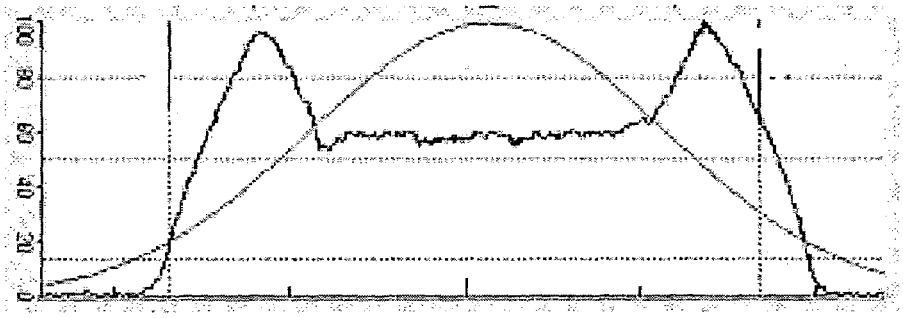
FIG. 10 is a schematic diagram showing the light intensity distribution of orthogonal cross-section to a traveling direction of the laser beam used in the image erasing step of Example 1 and the image forming step of Example 3.

When a light intensity distribution of cross-section in a direction approximately perpendicular to the traveling direction of the laser beam was measured similarly by using a laser beam profiler, BeamOn (by Duma Optronics Ltd.) at this time, a light intensity distribution curve as shown in FIG. 10 was obtained. Moreover, the differentiation curve, the light intensity distribution curve which has been differentiated once (X') and twice (X") is shown in FIG. 1D and from these figures it turns out that the light irradiation intensity of the center is 0.6 times of the light irradiation intensity of the periphery.

It was possible to perform image forming and erasing uniformly when the image forming step and the image erasing step were repeated for 100 times in the above condition.

Example 2

Example 2 is an example corresponding to the first aspect of the method for image processing of the present invention.

<Image Forming Step>

The fiber coupling type, high-output semiconductor laser apparatus of Example 1 was used and it was adjusted to have a laser output of 25 W, an irradiation distance of 88.0 mm and a spot diameter of approximately 2.0 mm. A laser beam was irradiated to the thermoreversible recording medium prepared in Example 1 at a XY stage feed rate at 1,200 mm/s to form a linear image.

Figure 9:
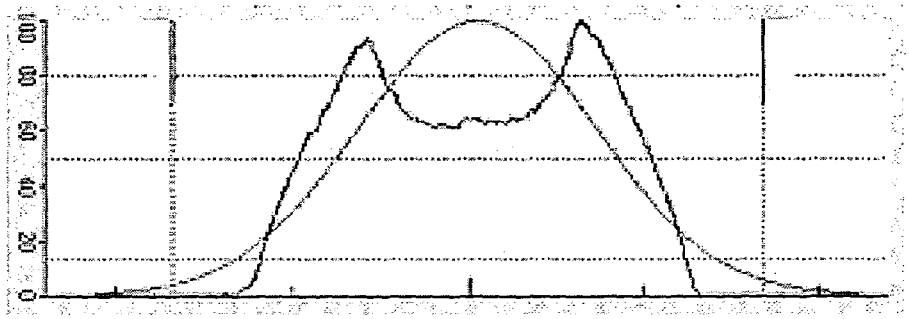
FIG. 9 is a schematic diagram showing the light intensity distribution of orthogonal cross-section to a traveling direction of the laser beam used in the image forming steps of Examples 2 and 5.

At this time, five ND filters were used for light extinction to adjust the laser output to be 0.01% or less as similar to Example 1. When a light intensity distribution of cross-section in a direction approximately perpendicular to the traveling direction of the laser beam was measured similarly to Example 1, a light intensity distribution curve as shown in FIG. 9 was obtained. Moreover, the differentiation curve, the light intensity distribution curve which has been differentiated once (X') and twice (X"), is shown in FIG. 1D and from these figures it turns out that the light irradiation intensity of the center is 0.7 times of the light irradiation intensity of the periphery.

<Image Erasing Step>

Subsequently, the linear image formed on the thermoreversible recording medium was erased by means of the laser apparatus in a condition as similar to Example 1.

It was possible to perform image forming and erasing uniformly when the image forming step and the image erasing step were repeated for 300 times in the above condition.

Example 3

Example 3 is an example corresponding to the first aspect of the method for image processing of the present invention.

<Image Forming Step>

The fiber coupling type, high-output semiconductor laser apparatus of Example 1 was used and it was adjusted to have a laser output of 35 W, an irradiation distance of 86.0 mm and a spot diameter of 3.0 mm. A laser beam was irradiated to the thermoreversible recording medium prepared in Example 1 at a XY stage feed rate of 1,200 mm/s to form a linear image.

At this time, five ND filters were used for light extinction to adjust the laser output to be 0.01% or less as similar to Example 1. When a light intensity distribution of cross-section in a direction approximately perpendicular to the traveling direction of the laser beam was measured similarly to Example 1, a light intensity distribution curve as shown in FIG. 10 was obtained. Moreover, the differentiation curve, the light intensity distribution curve which has been differentiated once (X') and twice (X"), is shown in FIG. 1D, and from these figures it turns out that the light irradiation intensity of the center is 0.6 times of the light irradiation intensity of the periphery.

<Image Erasing Step>

Subsequently, the linear image formed on the thermoreversible recording medium was erased by means of the laser apparatus in a condition as similar to Example 1.

It was possible to perform image forming and erasing uniformly when the image forming step and the image erasing step were repeated for 300 times in the above condition.

Example 4

Example 4 is an example corresponding to the first aspect of the method for image processing of the present invention.

<Preparation of Thermoreversible Recording Medium>

A thermoreversible recording medium was prepared as similar to Example 1, except for not using the photothermal conversion material as used for the preparation of the thermoreversible recording medium in Example 1.

<Image Forming Step>

A laser marker equipped with $CO_2$ laser of 40 W output (LP-440 by SUNX Limited) was used and a mask which cuts the center of the laser beam was built onto the light path of the laser beam. The light irradiation intensity of the center was then adjusted to be 0.5 times of the light irradiation intensity of the periphery in the light intensity distribution of cross-section in a direction approximately perpendicular to the traveling direction of the laser beam.

Next, a linear image was formed by irradiating a laser beam to the prepared thermoreversible recording medium by means of the laser marker which was adjusted to have a laser output of 6.5 W, an irradiation distance of 185 mm, a spot diameter of 0.18 mm and a scan speed of 1,000 mm/s.

<Image Erasing Step>

Subsequently, the mask which cuts the center of the laser beam was detached from the light path of the laser marker and the laser marker was adjusted to have a laser output of 22 W, an irradiation distance of 155 mm, a spot diameter of approximately 2 mm and a scan speed of 3,000 mm/s. The image formed on the thermoreversible recording medium was then erased.

It was possible to perform image forming and erasing uniformly when the image forming step and the image erasing step were repeated for 300 times in the above condition.

Example 5

Example 5 is an example corresponding to the first aspect of the method for image processing of the present invention.

<Preparation of Thermoreversible Recording Medium>

A thermoreversible recording medium in which transparency changes reversibly (between clear state and clouded state) depending on temperatures was prepared as follow.

—Support—

A transparent PET film (Lumilar 175-T12 by Toray Industries, Inc.) of 175 μm thickness was used as a support.

—Reversible Thermosensitive Recording Layer (Recording Layer)—

A uniform dispersion liquid was prepared by adding 3 parts by mass of organic low-molecular material expressed by the following Structural Formula (5) and 7 parts by mass of docosyl benenate into a resin solution in which 26 parts by mass of vinyl chloride copolymer (M110 by Zeon Corp.) was added to 210 parts by mass of methyl ethyl ketone, putting ceramic beads of 2 mm diameter in a glass bottle and dispersing for 48 hours by means of a paint shaker (by Asada Iron Works, Co., Ltd.).

(Organic Low-Molecular Material)

Structural Formula 5

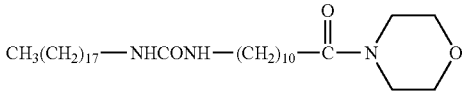

Next, 0.07 parts by weight of photothermal conversion material (Excolor® IR-14 by Nippon Shokubai Co., Ltd.) and 4 parts by mass of isocyanate compound (Colonate 2298-90T by Nippon Polyurethane Industry Co., Ltd.) were added to the obtained dispersion liquid to prepare a thermosensitive recording layer liquid.

The support (an adhesion layer of PET film having a magnetic recording layer) was then coated with the obtained thermosensitive recording layer liquid, heated, dried and the resin was then cross-linked by being stored in an environment of 65° C. for 24 hours to dispose a thermosensitive recording layer of approximately 10 μm thickness.

—Protective Layer—

The thermosensitive recording layer was coated with a solution which consists of 10 parts by mass of 75% butyl acetate solution of urethane acrylate ultraviolet-curable resin (Unidic C7-157 by Dainippon Ink and Chemicals, Inc.) and 10 parts by mass of isopropyl alcohol by means of a wire bar, heated, dried and then hardened by irradiating an ultraviolet light by means of a high pressure mercury lamp of 80 W/cm to form a protective layer of approximately 3 μm thickness.

The thermoreversible recording medium was prepared as described above.

The fiber coupling type, high-output semiconductor laser apparatus of Example 1 was used and it was adjusted to have a laser output of 20 W, an irradiation distance of 88.0 mm and a spot diameter of 2.0 mm. A laser beam was irradiated to the prepared thermoreversible recording medium at a XY stage feed rate of 1,200 mm/s to form a linear image.

At this time, five ND filters were used for light extinction to adjust the laser output to be 0.01% or less as similar to Example 1. When a light intensity distribution of cross-section in a direction approximately perpendicular to the traveling direction of the laser beam was measured similarly to Example 1, a light intensity distribution curve as shown in FIG. 9 was obtained as similar to Example 2. And it turns out that the light irradiation intensity of the center is 0.7 times of the light irradiation intensity of the periphery.

<Image Erasing Step>

Subsequently, the linear image formed on the thermoreversible recording medium was erased by means of the laser apparatus, which was adjusted to have a laser output of 12 W, an irradiation distance of 86 mm, a spot diameter of 3.0 mm, at a XY stage feed rate of 1,200 mm/s.

It was possible to perform image forming and erasing uniformly when the image forming step and the image erasing step were repeated for 300 times in the above condition.

Example 6

Example 6 is an example corresponding to the first aspect of the method for image processing of the present invention.

<Image Forming Step>

The laser marker of Example 4 was used and it was adjusted to have a laser output of 10.4 W, an irradiation distance of 195 mm, a line width of 0.5 mm, a spot diameter of approximately 0.9 mm and a scan speed of 1,000 mm/s. A laser beam was irradiated to the thermoreversible recording medium prepared in Example 4 to form a linear image.

The light intensity distribution of cross-section in a direction approximately perpendicular to the traveling direction of the laser beam irradiated at this time was as such that the light irradiation intensity of the center is 1.04 times of the light irradiation intensity of the periphery.

<Image Erasing Step>

Subsequently, the linear image formed on the thermoreversible recording medium was erased by using the laser marker which was adjusted to have a laser output of 22 W, an irradiation distance of 155 mm, a spot diameter of approximately 2 mm and a scan speed of 3,000 mm/s.

It was possible to perform image forming and erasing uniformly when the image forming step and the image erasing step were repeated for 100 times in the above condition.

Example 7

Example 7 is an example corresponding to the first aspect of the method for image processing of the present invention.

<Image Forming Step>

The laser marker of Example 4 was used and it was adjusted to have a laser output of 16.0 W, an irradiation distance of 200 mm, a line width of 0.7 mm, a spot diameter of approximately 1.3 mm and a scan speed of 1,000 mm/s. A laser beam was irradiated to the thermoreversible recording medium prepared in Example 4 to form a linear image.

The light intensity distribution of cross-section in a direction approximately perpendicular to the traveling direction of the laser beam irradiated at this time was as such that the light irradiation intensity of the center is 1.03 times of the light irradiation intensity of the periphery.

<Image Erasing Step>

Subsequently, the linear image formed on the thermoreversible recording medium was erased by using the laser marker which was adjusted to have a laser output of 22 W, an irradiation distance of 155 mm, a spot diameter of approximately 2 mm and a scan speed of 3,000 mm/s.

It was possible to perform image forming and erasing uniformly when the image forming step and the image erasing step were repeated for 200 times in the above condition.

Example 8

Example 8 is an example corresponding to the first aspect of the method for image processing of the present invention.

<Image Forming Step>

The laser marker of Example 4 was used and it was adjusted to have a laser output of 7.5 W, an irradiation distance of 195 mm, a line width of 0.5 mm, a spot diameter of approximately 1.3 mm and a scan speed of 1,000 mm/s. A laser beam was irradiated to the thermoreversible recording medium prepared in Example 5 to form a linear image.

The light intensity distribution of cross-section in a direction approximately perpendicular to the traveling direction of the laser beam irradiated at this time was a light intensity distribution as similar to Example 6.

<Image Erasing Step>

Subsequently, the linear image formed on the thermoreversible recording medium was erased by using the laser marker which was adjusted to have a laser output of 13 W, an irradiation distance of 155 mm, a spot diameter of approximately 2 mm and a scan speed of 3,000 mm/s.

It was possible to perform image forming and erasing uniformly when the image forming step and the image erasing step were repeated for 200 times in the above condition.

Example 9

Example 9 is an example corresponding to the first aspect of the method for image processing of the present invention.

<Image Forming Step>

A linear image was formed similarly to Example 4 by using the laser marker and the thermoreversible recording medium of Example 4.

<Image Erasing Step>

Subsequently, the image was erased by using a heat gradient tester (TYPE HG-100 by Toyo Seiki Seisakusho Ltd.) with a pressure of 1 kgf/cm$^2$ at 140° C. for one second.

It was possible to perform image forming and erasing uniformly when the image forming step and the image erasing step were repeated for 300 times in the above condition.

Comparative Example 1

Comparative Example 1 is a comparative example relative to the first aspect of the method for image processing of the present invention.

<Image Forming Step>

The fiber coupling type, high-output semiconductor laser apparatus of Example 1 was used and it was adjusted to have a laser output of 12 W, an irradiation distance of 92.0 mm and a spot diameter of approximately 0.6 mm. A laser beam was irradiated to the thermoreversible recording medium prepared in Example 1 at a XY stage feed rate of 1,200 mm/s to form a linear image.

Figure 11:
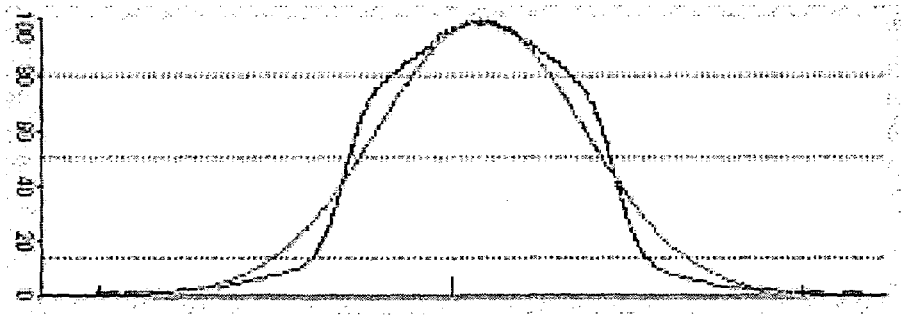
FIG. 11 is a schematic diagram showing the light intensity distribution (Gaussian distribution) of orthogonal cross-section to a traveling direction of the laser beam used in the image forming steps of Comparative Example 1.

When a light intensity distribution of cross-section in a direction approximately perpendicular to the traveling direction of the laser beam irradiated at this time was measured by means of a laser beam profiler BeamOn (by Duma Optronics Ltd.), a light intensity distribution curve as shown in FIG. 11 was obtained. Moreover, the differentiation curve, the light intensity distribution curve which has been differentiated once (X') and twice (X"), is shown in FIG. 1E, and from these figures it turns out that the light irradiation intensity of the center is 1.3 times of the light irradiation intensity of the periphery.

<Image Erasing Step>

Subsequently, the image was erased by using a heat gradient tester (TYPE HG-100 by Toyo Seiki Seisakusho Ltd.) with a pressure of 1 kgf/cm$^2$ at 140° C. for one second.

When the image forming step and the image erasing step were repeated in the above condition, non-erased area appeared at the center of the linear image after 30 times.

Comparative Example 2

Comparative Example 2 is a comparative example relative to the first aspect of the method for image processing of the present invention.

<Image Forming Step>

A linear image was formed by irradiating a laser beam to the thermoreversible recording medium prepared in Example 4 by means of a laser marker equipped with a $CO_2$ laser of 40 W output (LP-440 by SUNX Limited) which was adjusted to have a laser output of 4.7 W, an irradiation distance of 185 mm, a spot diameter of approximately 0.2 mm and a scan speed of 1,000 mm/s.

When the light intensity distribution of cross-section in a direction approximately perpendicular to the traveling direction of the laser beam was measured by means of a beam analyzer for high power, LPK-CO2-16 (by Spiricon, Inc.), the light intensity distribution was as such that the light irradiation intensity of the center is 1.25 times of the light irradiation intensity of the periphery.

<Image Erasing Step>

Subsequently, the image was erased by using a heat gradient tester (TYPE HG-100 by Toyo Seiki Seisakusho Ltd.) with a pressure of 1 kgf/cm$^2$ at 140° C. for one second.

When the image forming step and the image erasing step were repeated in the above condition, non-erased area appeared at the center of the linear image after 50 times.

Comparative Example 3

Comparative Example 3 is a comparative example relative to the first aspect of the method for image processing of the present invention.

<Image Forming Step>

A linear image was formed similarly to Comparative Example 2 by using the laser marker and the thermoreversible recording medium of Comparative Example 2.

The light intensity distribution of cross-section in a direction approximately perpendicular to the traveling direction of the laser beam at this time was as such that the light irradiation intensity of the center is 1.25 times of the light irradiation intensity of the periphery.

Subsequently, the laser marker was used and adjusted to have a laser output of 2.0 W, an irradiation distance of 185 mm, a spot diameter of 0.18 mm and a scan speed of 2,500 mm/s. The linear image formed on the thermoreversible recording medium was erased by scanning 20 laser beams parallel to each other in a linear form so as to have intervals of 0.01 mm in a direction approximately perpendicular to the scanning direction of the laser beam.

The light intensity distribution of cross-section in a direction approximately perpendicular to the traveling direction of the laser beam was similar to the one in the image forming step.

When the image forming step and the image erasing step were repeated in the above condition, non-erased area appeared at the center of the linear image after 50 times.

Example 10

Example 10 is an example corresponding to the second aspect of the method for image processing of the present invention.

<Image Forming Step>

A linear image was formed in an area of 10 mm×50 mm by irradiating a laser beam to the thermoreversible recording medium prepared in Example 4 by means of a laser marker equipped with a $CO_2$ laser of 40 W output (LP-440 by SUNX Limited) which was adjusted to have a laser output of 4.7 W, an irradiation distance of 185 mm, a spot diameter of 0.18 mm and a scan speed of 1,000 mm/s.

<Image Erasing Step>

Figure 12:
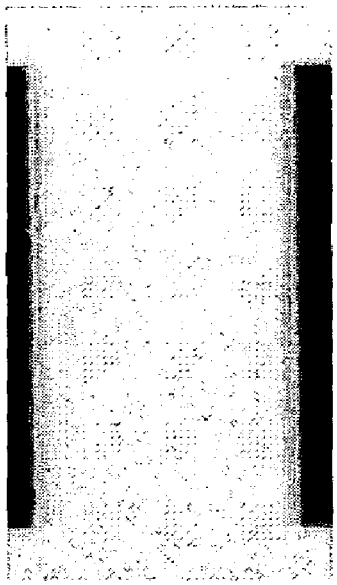
FIG. 12 is a photograph showing a thermoreversible recording medium after image erasing in Example 9.

The laser marker was then adjusted to have a laser output of 32 W, an irradiation distance of 224 mm, a spot diameter of 3.0 mm (17 times of the spot diameter during image forming in the image forming step) and a scan speed of 4,500 mm/s. 34 laser beams were scanned in the area of 10 mm×50 mm parallel to each other in a linear form so as to have intervals of 0.30 mm, which is equivalent to 1/10 of the spot diameter, in a direction approximately perpendicular to the scanning direction of the laser beam. When the image density was measured by means of a Macbeth densitometer RD914, the density of the image erasing area was 0.09 and as shown in FIG. 12, the image formed on the thermoreversible recording medium was completely erasable. Moreover, the erasing time of the image at this time was 0.53 seconds.

Subsequently, when the image was erased in the erasing condition of the image erasing step while moving the thermoreversible recording medium, on which an image was formed in the image forming step, which has been attached to a plastic box and placed on a conveyer at a feed rate of 13 m/min., the traveling time of the thermoreversible recording medium was 0.59 seconds and the image in the area of 10 mm×50 mm was completely erased.

Example 11

Example 11 is an example corresponding to the second aspect of the method for image processing of the present invention.

<Image Forming Step>

A laser beam was irradiated to the thermoreversible recording medium as similar to Example 6 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 224 mm, a spot diameter of 3.0 mm and a scan speed of 3,200 mm/s. 23 laser beams were scanned in the area of 10 mm×50 mm parallel to each other in a linear form so as to have intervals of 0.43 mm, which is equivalent to 1/7 of the spot diameter, in a direction approximately perpendicular to the scanning direction of the laser beam. When the image density was measured by means of a Macbeth densitometer RD914, the density of the image erasing area was 0.09 and the image formed on the thermoreversible recording medium was completely erasable. Moreover, the erasing time of the image at this time was 0.51 seconds.

Example 12

Example 12 is an example corresponding to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

Image Erasing Step>

The laser marker was then adjusted to have a laser output of 2 W, an irradiation distance of 224 mm, a spot diameter of 3.0 mm and a scan speed of 2,600 mm/s. 17 laser beams were scanned in the area of 10 mm×50 mm parallel to each other in a linear form so as to have intervals of 0.60 mm, which is equivalent to ⅕ of the spot diameter, in a direction approximately perpendicular to the scanning direction of the laser beam. When the image density was measured by means of a Macbeth densitometer RD914, the density of the image erasing area was 0.09 and the image formed on the thermoreversible recording medium was completely erasable. Moreover, the erasing time of the image at this time was 0.43 seconds.

Example 13

Example 13 is an example corresponding to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 224 mm, a spot diameter of 3.0 mm and a scan speed of 2,400 mm/s. 14 laser beams were scanned in the area of 10 mm×50 mm parallel to each other in a linear form so as to have intervals of 0.75 mm, which is equivalent to ¼ of the spot diameter, in a direction approximately perpendicular to the scanning direction of the laser beam. When the image density was measured by means of a Macbeth densitometer RD914, the density of the image erasing area was 0.09 and the image formed on the thermoreversible recording medium was completely erasable. Moreover, the erasing time of the image at this time was 0.38 seconds.

Example 14

Example 14 is an example corresponding to the second aspect of the method for image processing of the present invention.

<Image Forming Step>

A laser beam was irradiated to the thermoreversible recording medium as similar to Example 4 by using the laser marker and the thermoreversible recording medium of Example 4 to form a linear image in an area of 10 mm×50 mm.

<Image Erasing Step>

A laser beam was then irradiated to the area of 10 mm×50 mm as similar to the image erasing step of Example 13 after the mask, which cuts the center of the laser beam, was removed from the light path of the laser marker. When the image density was measured by means of a Macbeth densitometer RD914, the density of the image erasing area was 0.09 and the image formed on the thermoreversible recording medium was completely erasable. Moreover, the erasing time of the image at this time was 0.38 seconds.

It was possible to perform uniform image forming, and uniform erasing in a short period of time when the image forming step and the image erasing step were repeated for 300 times in the above condition.

Example 15

Example 15 is an example corresponding to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 204 mm, a spot diameter of 1.6 mm (9 times of the spot diameter during image forming in the image forming step) and a scan speed of 8,000 mm/s. When 50 laser beams were scanned in the area of 10 mm×50 mm parallel to each other in a linear form so as to have intervals of 0.20 mm in a direction approximately perpendicular to the scanning direction of the laser beam, the image was completely erasable. Moreover, the erasing time of the image at this time was 0.63 seconds.

Example 16

Example 16 is an example corresponding to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 207 mm, a spot diameter of 1.8 mm (10 times of the spot diameter during image forming in the image forming step) and a scan speed of 7,500 mm/s. When 45 laser beams were scanned in the area of 10 mm×50 mm parallel to each other in a linear form so as to have intervals of 0.23 mm in a direction approximately perpendicular to the scanning direction of the laser beam, the image was completely erasable. Moreover, the erasing time of the image at this time was 0.55 seconds.

Example 17

Example 17 is an example corresponding to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 265 mm, a spot diameter of 6.0 mm (33 times of the spot diameter during image forming in the image forming step) and a scan speed of 1,600 mm/s. When 14 laser beams were scanned in the area of 10 mm×50 mm parallel to each other in a linear form so as to have intervals of 0.75 mm in a direction approximately perpendicular to the scanning direction of the laser beam, the image was completely erasable. Moreover, the erasing time of the image at this time was 0.53 seconds.

Example 18

Example 18 is an example corresponding to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 279 mm, a spot diameter of 7.0 mm (38.9 times of the spot diameter during image forming in the image forming step) and a scan speed of 1,000 mm/s. When 12 laser beams were scanned in the area of 10 mm×50 mm parallel to each other in a linear form so as to have intervals of 0.88 mm in a direction approximately perpendicular to the scanning direction of the laser beam, the image was completely erasable. Moreover, the erasing time of the image at this time was 0.71 seconds.

Subsequently, when the image was erased in the erasing condition of the image erasing step while moving the thermoreversible recording medium, on which an image was formed in the image forming step, which has been attached to a plastic box and placed on a conveyer, at a feed rate of 13 m/min., the image in the area of 10 mm×50 mm was not completely erased because the traveling time of the thermoreversible recording medium was 0.59 seconds.

Example 19

Example 19 is an example corresponding to the second aspect of the method for image processing of the present invention.

<Image Forming Step>

The laser marker and the thermoreversible recording medium of Example 10 were used and the laser marker was adjusted to have a laser output of 14 W, an irradiation distance of 200 mm, a spot diameter of 1.3 mm and a scan speed of 1,000 mm/s. A linear image was formed in an area of 10 mm×50 mm by irradiating the laser beam to the thermoreversible recording medium.

<Image Erasing Step>

The laser marker was then adjusted to have a laser output of 32 W, an irradiation distance of 200 mm, a spot diameter of 1.3 mm (1.0 time of the spot diameter during image forming in the image forming step) and a scan speed of 1,000 mm/s. When 63 laser beams were scanned in the area of 10 mm×50 mm parallel to each other in a linear form so as to have intervals of 0.16 mm in a direction approximately perpendicular to the scanning direction of the laser beam, the image was completely erasable. Moreover, the erasing time of the image at this time was 0.63 seconds.

Subsequently, when the image was erased in the erasing condition of the image erasing step while moving the thermoreversible recording medium, on which an image was formed in the image forming step, which has been attached to a plastic box and placed on a conveyer, at a feed rate of 13 m/min., the image in the area of 10 mm×50 mm was not completely erased because the traveling time of the thermoreversible recording medium was 0.59 seconds.

Example 20

Example 20 is an example corresponding to the second aspect of the method for image processing of the present invention.

<Preparation of Thermoreversible Recording Medium>

A thermoreversible recording medium was prepared as similar to Example 5, except for not using the photothermal conversion material as used during preparation of the thermoreversible recording medium in Example 5.

<Image Forming Step>

A linear image was formed in an area of 10 mm×50 mm by irradiating a laser beam to the prepared thermoreversible recording medium by means of a laser marker equipped with a $CO_2$ laser of 40 W output (LP-440 by SUNX Limited) which was adjusted to have a laser output of 3.2 W, an irradiation distance of 185 mm, a spot diameter of 0.18 mm and a scan speed of 1,000 mm/s.

<Image Erasing Step>

The laser marker was then adjusted to have a laser output of 17 W, an irradiation distance of 224 mm, a spot diameter of 3.0 mm and a scan speed of 2,400 mm/s. 17 laser beams were scanned in the area of 10 mm×50 mm parallel to each other in a linear form so as to have intervals of 0.60 mm, which is equivalent to ⅕ of the spot diameter, in a direction approximately perpendicular to the scanning direction of the laser beam. When the image density was measured by means of a Macbeth densitometer RD914 with a black paper (O.D.2.0) on the background, the density of the image erasing area was 1.60 and the image formed on the thermoreversible recording medium was completely erasable. Moreover, the erasing time of the image at this time was 0.43 seconds.

Comparative Example 4

Comparative Example 4 is a comparative example relative to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

<Image Erasing Step>

The laser marker was then adjusted to have a laser output of 32 W, an irradiation distance of 224 mm, a spot diameter of 3.0 mm and a scan speed of 6,000 mm/s. 50 laser beams were scanned in the area of 10 mm×50 mm parallel to each other in a linear form so as to have intervals of 0.20 mm, which is equivalent to 1/15 of the spot diameter, in a direction approximately perpendicular to the scanning direction of the laser beam. When the image density was measured by means of a Macbeth densitometer RD914, the density of the image erasing area was 0.09 and the image formed on the thermoreversible recording medium was completely erasable, however, the erasing time at this time was 0.68 seconds, and it took a long time for erasing. With that, when the image was erased in the erasing condition of the image erasing step while moving the thermoreversible recording medium, on which an image was formed in the image forming step, which has been attached to a plastic box and placed on a conveyer, at a feed rate of 13 m/min., the image in the area of 10 mm×50 mm was not completely erased because the traveling time of the thermoreversible recording medium was 0.59 seconds.

Comparative Example 5

Comparative Example 5 is a comparative example relative to the second aspect of the method for image processing of the present invention.

<Image Forming Step>

A laser beam was irradiated to the thermoreversible recording medium as similar to Example 10 by using the laser marker and the thermoreversible recording medium of Example 10 to form a linear image in an area of 10 mm×50 mm.

Image Erasing Step>

Figure 13:
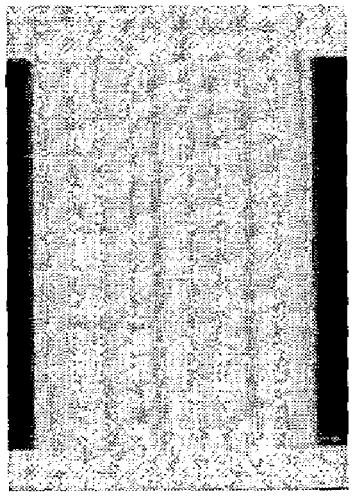
FIG. 13 is a photograph showing a thermoreversible recording medium after image erasing in Comparative Example 4.

The laser marker was then adjusted to have a laser output of 32 W, an irradiation distance of 224 mm, a spot diameter of 3.0 mm and a scan speed of 1,600 mm/s. 7 laser beams were scanned in the area of 10 mm×50 mm parallel to each other in a linear form so as to have intervals of 1.5 mm, which is equivalent to ½ of the spot diameter, in a direction approximately perpendicular to the scanning direction of the laser beam. When the image density was measured by means of a Macbeth densitometer RD914, the density of the image erasing area was 0.13 and the image formed on the thermoreversible recording medium was not completely erasable as shown in FIG. 13. The erasing time at this time was 0.27 seconds.

Example 21

Example 21 is an example corresponding to the third aspect of the method for image processing of the present invention.

<Image Forming Step>

Using the laser marker and the thermoreversible recording medium of Example 10, 3 laser beams were scanned the length of 100 mm in the similar condition as in Example 10 so as to be parallel to each other in a linear form and have intervals of 0.15 mm in a direction approximately perpendicular to the scanning direction of the laser beam at 60-second intervals. The laser beams were scanned in a way so that the irradiation area of the second laser beam overlaps the irradiation area of the first laser beam and the irradiation area of the third laser beam overlaps the irradiation area of the second beam. As a result, a uniform image of 100 mm×0.5 mm width was formed without image density of the overlapped area (between laser beam scanning) of the laser beam irradiation becoming low.

Figure 14:
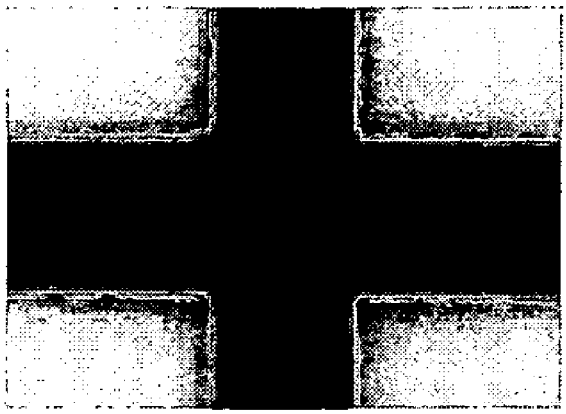
FIG. 14 is a photograph showing an intersecting point of a crossed, striated image formed in Example 18.

Furthermore, after a first laser beam was scanned in a linear form in the above laser condition, a second laser beam was scanned in a linear form in the similar laser condition so as to be overlapped with the irradiation area of the first laser beam in a direction perpendicular to the scanning direction of the first laser beam after 60 seconds of the scanning of the first laser beam. When the image density of the intersecting point of these laser beam irradiation areas was measured by means of a Macbeth densitometer RD914, the image density was 1.53 and the area erased by the intersecting point did not exist as shown in FIG. 14.

Example 22

Example 22 is an example corresponding to the third aspect of the method for image processing of the present invention.

<Image Forming Step>

Using the laser marker and the thermoreversible recording medium of Example 4, a laser beam was scanned the length of 100 mm in a linear form in the similar condition as for the image forming step of Example 4 as similar to Example 21 and 3 laser beams were then scanned so as to be parallel to each other in a linear form and have intervals of 0.15 mm in a direction approximately perpendicular to the scanning direction of the laser beam at 60-second intervals. As a result, a uniform image of 100 mm×0.5 mm width was formed without image density of the overlapped area (between laser beam scanning) of the laser beam irradiation becoming low.

Furthermore, after a first laser beam was scanned in a linear form in the above laser condition, a second laser beam was scanned in a linear form in the similar laser condition so as to be overlapped with the irradiation area of the first laser beam in a direction perpendicular to the scanning direction of the first laser beam after 60 seconds of the scanning of the first laser beam. The erased area did not exist in these intersecting points of the irradiated area of the laser beam as similar to Example 21.

Comparative Example 6

Comparative Example 6 is a comparative example relative to the third aspect of the method for image processing of the present invention.

<Image Forming Step>

An image was formed as similar to Example 21 except for scanning 3 laser beams in parallel in a linear form so as to have intervals of 0.15 mm in a direction approximately perpendicular to the scanning direction of the laser beam at 90-second intervals after a laser beam was scanned 100 mm in a linear form. As a result, areas of low image density existed in overlapped area (between laser beam scanning) of the laser beam irradiation and uniform image was not formed.

Figure 15:
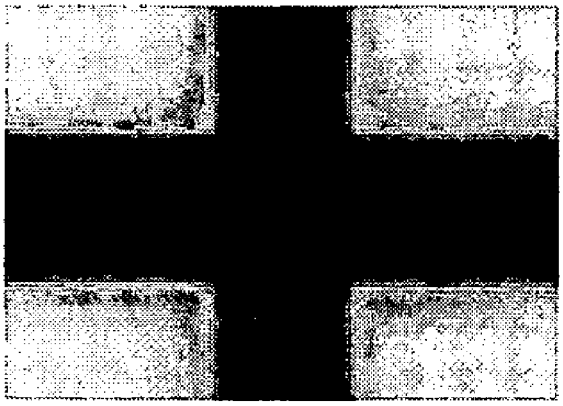
FIG. 15 is a photograph showing an intersecting point of a crossed, linear image formed in Comparative Example 5.

Furthermore, after a first laser beam was scanned in a linear form in the laser condition as similar to Example 21, a second laser beam was scanned in a linear form in the similar laser condition so as to be overlapped with the irradiation area of the first laser beam in a direction perpendicular to the scanning direction of the first laser beam after 90 seconds of the scanning of the first laser beam. When the image intensity of the intersecting point of these laser beam irradiation areas was measured by means of a Macbeth densitometer RD914, the image density was 0.10 and there were areas erased by the intersecting point as shown in FIG. 15.

Example 23

Example 23 is an example corresponding to the third aspect of the method for image processing of the present invention.

<Preparation of Thermoreversible Recording Medium>

A thermoreversible recording medium was prepared as similar to Example 10 except for changing the reversible developer in the recording layer of the thermoreversible recording medium of Example 10 to the reversible developer expressed by the following Structural Formula (6).

(Reversible Developer)

Structural Formula 6

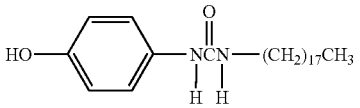

<Image Forming Step>

An image was formed on the obtained thermoreversible recording medium by using the laser marker of Example 10. The laser marker was adjusted to have a laser output of 3.5 W, an irradiation distance of 185 mm, a spot diameter of approximately 0.2 mm and a scan speed of 1,000 mm/s. 3 laser beams were then scanned the length of 100 mm in parallel in a linear form so as to have intervals of 0.15 mm in a direction approximately perpendicular to the scanning direction of the laser beam in succession. The laser beams were scanned in a way so that the irradiation area of the second laser beam overlaps the irradiation area of the first laser beam and the irradiation area of the third laser beam overlaps the irradiation area of the second beam. As a result, a uniform image of 100 mm×0.5 mm width was formed without image density of the overlapped area (between laser beam scanning) of the laser beam irradiation becoming low.

Furthermore, after a first laser beam was scanned in a linear form in the above laser condition, a second laser beam was scanned in a linear form in the similar laser condition so as to be overlapped with the irradiation area of the first laser beam in a direction perpendicular to the scanning direction of the first laser beam after 0.1 seconds of the scanning of the first laser beam. When the image intensity of the intersecting point of these laser beam irradiation areas was measured by means of a Macbeth densitometer RD914, the image density was 1.60 and the area erased by the intersecting point did not exist.

Comparative Example 7

Comparative Example 7 is a comparative example relative to the third aspect of the method for image processing of the present invention.

<Image Forming Step>

An image was formed as similar to Example 23 except for scanning a laser beam the length of 100 nm in a linear form and then scanning 3 laser beams in parallel in a linear form so as to have intervals of 0.15 mm in a direction approximately perpendicular to the scanning direction of the first laser beam at 0.2-second intervals. As a result, areas of low image density existed in overlapped area (between laser beam scanning) of the laser beam irradiation and uniform image was not formed.

Furthermore, after a first laser beam was scanned in a linear form in the laser condition as similar to Example 23, a second laser beam was scanned in a linear form in the similar laser condition so as to be overlapped with the irradiation area of the first laser beam in a direction perpendicular to the scanning direction of the first laser beam after 0.2 seconds of the scanning of the first laser beam. When the image intensity of the intersecting point of these laser beam irradiation areas by means of a Macbeth densitometer RD914, the image density was 0.10 and there were areas erased by the intersecting point.

Example 24

Example 24 is an example corresponding to the third aspect of the method for image processing of the present invention.

<Image Forming Step>

An image was formed on the thermoreversible recording medium of Example 20 by using the laser marker of Example 20. The laser marker was adjusted to have a laser output of 3.2 W, an irradiation distance of 185 mm, a spot diameter of approximately 0.2 mm and a scan speed of 1,000 mm/s. A laser beam was scanned the length of 100 mm in a linear form and 3 laser beams were then scanned in parallel in a linear form so as to have intervals of 0.15 mm in a direction approximately perpendicular to the scanning direction of the first laser beam in succession. The laser beams were scanned in a way so that the irradiation area of the second laser beam overlaps the irradiation area of the first laser beam and the irradiation area of the third laser beam overlaps the irradiation area of the second laser beam. As a result, a uniform image of 100 mm×0.5 mm width was formed without image density of the overlapped area (between laser beam scanning) of the laser beam irradiation becoming low.

Furthermore, when after a first laser beam was scanned in a linear form in the above laser condition, a second laser beam was scanned in a linear form in the similar laser condition so as to be overlapped with the irradiation area of the first laser beam in a direction perpendicular to the scanning direction of the first laser beam after 0.1 seconds of the scanning of the first laser beam, erased areas did not exist in the intersecting point.

Comparative Example 8

Comparative Example 8 is a comparative example relative to the third aspect of the method for image processing of the present invention.

<Image Forming Step>

An image was formed as similar to Example 24 except for scanning a laser beam the length of 100 nm in a linear form and then scanning 3 laser beams in parallel to each other in a linear form so as to have intervals of 0.15 mm in a direction approximately perpendicular to the scanning direction of the first laser beam at 0.2-second intervals. As a result, areas of low image density existed in overlapped area (between laser beam scanning) of the laser beam irradiation and uniform image was not formed.

Furthermore, when after a first laser beam was scanned in a linear form in the above laser condition, a second laser beam was scanned in a linear form in the similar laser condition so as to be overlapped with the irradiation area of the first laser beam in a direction perpendicular to the scanning direction of the first laser beam after 0.2 seconds of the scanning of the first laser beam, unerased areas were observed in the intersecting points.

Example 25

Example 25 is an application example corresponding to the first aspect of the method for image processing of the present invention.

<Preparation of Label>

A label as a thermoreversible recording medium was prepared as follow.

First, the under layer and the recording layer were sequentially formed on the support used in Example 4 as similar to Example 4.

—Intermediate Layer—

A composition consisting of 20 parts by mass of 40% by mass solution of ultraviolet-absorbable polymer (PUVA-60MK-40K by Otsuka Chemical Co., Ltd., hydroxyl value: 60), 3.2 parts by mass of xylenediisocyanate (D-110N by Mitsui Chemicals Polyurethanes, Inc.) and 23 parts by mass of methyl ethyl ketone (MEK) was mixed well by means of a ball mill to prepare a coating liquid for layer containing polymer with an ultraviolet-absorbing structure.

Next, the support, on which the under layer and the recording layer have already been formed, was coated with the coating liquid for layer containing polymer with an ultraviolet-absorbing structure by means of a wire bar, dried at 90° C. for 1 minute and heated at 50° C. for 24 hours to form a layer (intermediate layer) containing polymer with an ultraviolet-absorbing structure of 2 μm thickness.

—Protective Layer—

Subsequently, a protective layer was formed on the prepared intermediate layer as similar to Example 4.

—Sticking Layer—

Next, a composition consisting of 50 parts by mass of acrylic sticking agent (BPS-1109 by Toyo Ink MFG. Co., Ltd.) and 2 parts by mass of isocyanate (D-170N by Mitsui Chemicals Polyurethanes Inc.) was mixed well to prepare a coating liquid for sticking layer.

The support, on which the under layer, the recording layer, the intermediate layer and the protective layer have already been formed, was coated with the obtained coating liquid for sticking layer on the side where the above layers are not formed by means of a wire bar, dried at 90° C. for 2 minutes to form a sticking layer of approximately 20 μm thickness.

A thermoreversible recording label was prepared by the above procedure.

<Image Forming Step and Image Erasing Step>

When the obtained thermoreversible label was cut in a size of 50 mm×100 mm, placed on a plastic box and image forming and image erasing were performed as similar to Example 4, uniform forming and erasing of images were possible.

Example 26

Example 26 is an application example corresponding to the first aspect of the method for image processing of the present invention.

<Preparation of Tag (Process Instruction)>

A tag (process instruction) as the thermoreversible recording medium was prepared as follow.

First, the recording layer, the intermediate layer and the protective layer were formed sequentially as similar to Example 4 on the support used in Example 4 to prepare a sheet for upper surface.

Next, only the back layer was formed as similar to Example 4 on the support used in Example 4 to prepare a sheet for lower surface.

Obtained sheet for upper surface and sheet for lower surface were cut in a size of 210 mm×85 mm respectively, RF-ID inlet (by DSM Nutritional Products) and PETG sheet (by Mitsubishi Plastics, Inc.) as a spacer for around the inlet were sandwiched in between these sheets and were bonded with an adhesive tape (by Nitto Denko Corporation) to prepare a thermoreversible recording tag (process instruction) with RF-ID of 500 μm thickness.

<Image Forming Step and Image Erasing Step>

When the obtained thermoreversible recording tag with RF-ID was placed on a plastic box and image forming and erasing were performed as similar to Example 4, uniform forming and erasing of images were possible.

Experimental Example 1

Experimental Example 1 is an experimental example corresponding to the second aspect of the method for image processing of the present invention.

Figure 16:
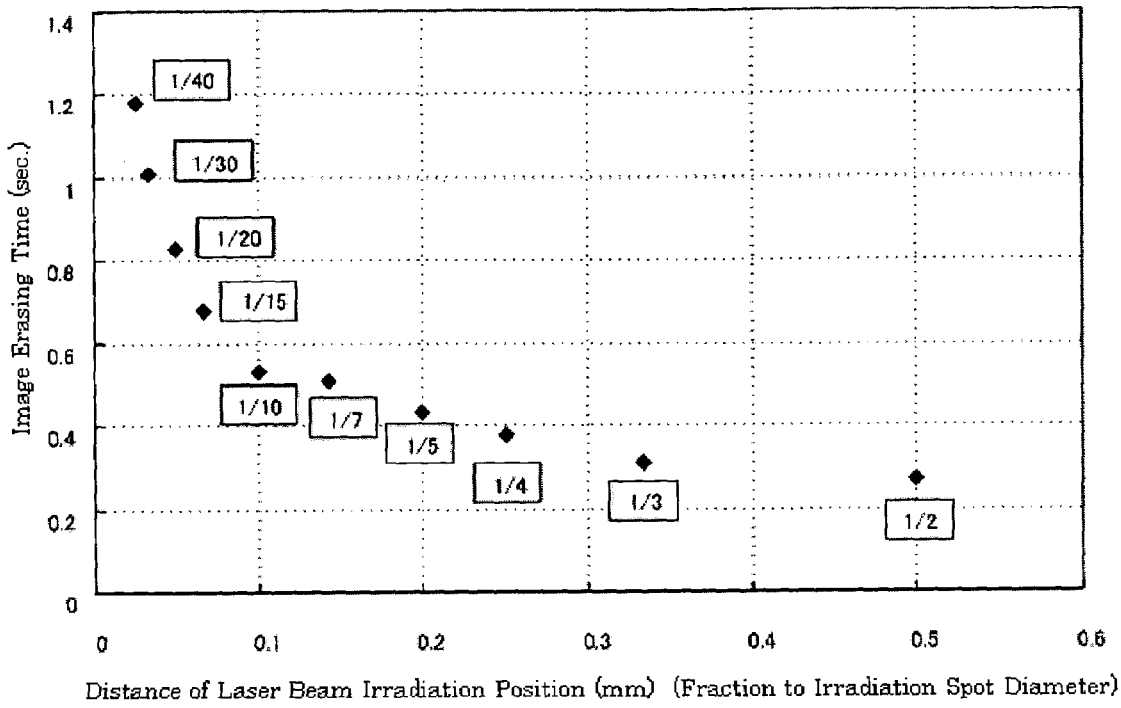
FIG. 16 is a graph showing a relation between image erasing time and distance of laser beam irradiation position (to the spot diameter ratio) in Experimental Example 1.

A linear image was formed in an area of 10 mm×50 mm as similar to Example 10. Next, image erasing was performed by fixing the laser irradiation condition to a laser output of 32 W, an irradiation distance of 224 mm and a spot diameter of 3.0 mm and changing the distance of laser beam irradiation position (fraction to irradiation spot diameter) within the range of 0.075 mm (1/40) to 1.5 mm (1/2) accordingly. The relation between the image erasing time and the distance of the laser beam irradiation position (fraction to irradiation spot diameter) at this time is shown in FIG. 16.

Meanwhile, when the image density of the image erasing area was measured by using a Macbeth densitometer RD914, images were not completely erased when the distance of laser beam irradiation position (fraction to irradiation spot diameter) was 1.0 mm (1/3) or more.

Experimental Example 2

Experimental Example 2 is an experimental example corresponding to the second aspect of the method for image processing of the present invention.

Figure 17:
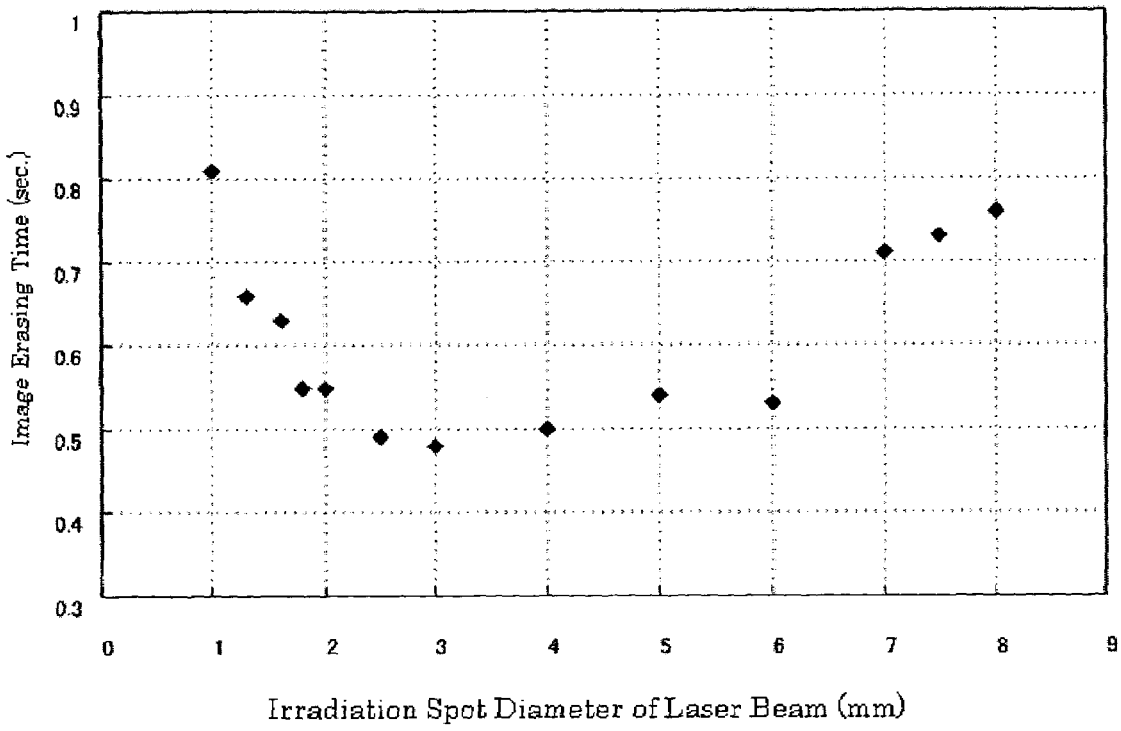
FIG. 17 is a graph showing a relation between image erasing time and irradiation spot diameter of a laser beam in Experimental Example 2.

A linear image was formed in an area of 10 mm×50 mm in the condition with the irradiation spot diameter of the laser beam being 0.18 mm as similar to Example 10. Next, image erasing was performed by fixing the laser irradiation condition to a laser output of 32 W and changing the irradiation spot diameter of the laser beam within the range of 0.6 mm to 8.0 mm accordingly. The relation between the image erasing time and the irradiation spot diameter of the laser beam at this time is shown in FIG. 17.

By the present invention, it is possible to settle above existing issues and to provide a method for image processing which is capable of performing repetitive forming and erasing of high-contrast images at high speeds by forming high-density, uniform images and uniformly erasing images in a short period of time and in addition, suppressing the degradation of the thermoreversible recording medium due to repetitive forming and erasing is possible, and an image processing apparatus which can be suitably used for the method for image processing.

The method for image processing and the image processing apparatus of the present invention are capable of performing repetitive forming and erasing of high contrast images on thermoreversible recording media such as labels placed on containers such as cardboards at high speeds and furthermore, degradation of the thermoreversible recording media due to repetition can be suppressed, therefore, they are particularly suitable for use in physical distribution and delivery systems.

What is claimed is:

1. A method for image processing, comprising:

at least any one of image forming step and image erasing step, wherein an image is formed on a thermoreversible recording medium in which any one of transparency and color tone is changed reversibly depending on temperatures attained by the medium by heating due to laser beam irradiation to the thermoreversible recording medium in the image forming step, an image formed on the thermoreversible recording medium is erased by heating due to laser beam irradiation to the thermoreversible recording medium in the image erasing step, and a light irradiation intensity of the center is 1.05 times or less than 1.05 times the light irradiation intensity of the periphery in the light intensity distribution of cross-section in a direction approximately perpendicular to the traveling direction of the laser beam irradiated at least in any one of the image forming step and the image erasing step.

2. The method for image processing according to claim 1, wherein the light irradiation intensity of the center is 1.03 times or less of the light irradiation intensity of the periphery in the light intensity distribution of cross-section in a direction approximately perpendicular to the traveling direction of the laser beam.

3. The method for image processing according to claim 1, wherein the light irradiation intensity of the center is smaller than the light irradiation intensity of the periphery in the light intensity distribution of cross-section in a direction approximately perpendicular to the traveling direction of the laser beam.

4. The method for image processing according to claim 1, wherein the light intensity distribution is applied to a surface of the thermoreversible recording medium during irradiation of the thermoreversible recording medium.

5. The method for image processing according to claim 1, wherein the thermoreversible recording medium comprises at least a resin and an organic low-molecular material.

6. The method for image processing according to claim 5, wherein the organic low-molecular material has a carbon number equal to or greater than 10 and less than or equal to 60.

7. The method for image processing according to claim 5, wherein the mass ratio or the organic low-molecular material to the resin is equal to or greater than 2:1 and equal to or less than 1:16.

8. The method for image processing according to claim 1, wherein the thermoreversible recording medium attains a lower temperature iii the image erasing step than in the image forming step.

9. The method for image processing according to claim 1, wherein the thermoreversible recording medium comprises a first major surface and a second major surface, the first major surface being the surface upon which the laser beam irradiation is incident, and the second major surface having an adhesive material formed thereon.

10. A method for image processing, comprising:

at least any one of image forming step and image erasing step, wherein an image is formed on a thermoreversible recording medium in which any one of transparency and color tone is changed reversibly depending on temperatures by heating due to laser beam irradiation to the thermoreversible recording medium in the image forming step, an image formed on the thermoreversible recording medium is erased by heating due to laser beam irradiation to the thermoreversible recording medium in the image erasing step, the image erasing step comprises erasing an image in a second image erasing area which is adjacent to a first image erasing area after erasing an image in the first image erasing area by scanning the laser beam, and the distance between the irradiation position of the laser beam to the first image erasing area and the irradiation position of the laser beam, to the second image erasing area is 1/12 to 1/4 of the irradiation spot diameter of the laser beam.

11. The method for image processing according to claim 10, wherein the irradiation spot diameter of the laser beam in the image erasing step is 1.2 times to 38 times of the irradiation spot diameter of the laser beam in the image forming step.

12. The method for image processing according to claim 10, wherein the light irradiation intensity of the center is equal to or less than the light irradiation intensity of the periphery in the light intensity distribution of cross-section in a direction approximately perpendicular to the traveling direction of the laser beam irradiated at least in any one of the image forming step and the image erasing step.

13. The method for image processing according to claim 10, wherein the light irradiation intensity of the center is 1.03 times or less than 1.03 times the light irradiation intensity of the periphery in the light intensity distribution of cross-section in a direction approximately perpendicular to the traveling direction of the laser beam irradiated at least in any one of the image forming step and the image erasing step.

14. A method for image processing, comprising:

at least any one of image forming step and image erasing step, wherein an image is formed on a thermoreversible recording medium, which comprises at least a resin and an organic low-molecular material and any one of transparency and color tone is changed reversibly depending on temperatures attained by the medium by heating due to laser beam irradiation to the thermoreversible recording medium in the image forming step, an image formed on the thermoreversible recording medium is erased by heating due to laser beam irradiation to the thermoreversible recording medium in the image erasing step, and the image forming step comprises forming an image in a second image forming area which is adjacent to a first image forming area after forming an image in the First image forming area by scanning the laser beam, and the laser beam is irradiated to the second image forming area so as to be overlapped with part of the first image forming area after the organic low-molecular material found in the first image forming area is melted prior to crystallization, wherein the light irradiation intensity of the center is equal to or less than the light irradiation intensity of the periphery in the light intensity distribution of cross-section in a direction approximately perpendicular to the traveling direction of the laser beam irradiated at least in any one of the image forming step and the image erasing step.

15. The method for image processing according to claim 14, wherein the organic low-molecular material in the thermoreversible recording medium is dispersed in the resin in form of particle, and transparency of the thermoreversible recording medium is changed reversibly between clear state and clouded state by heat.

16. The method for image processing according to claim 14, wherein the organic low-molecular material prior to melting is a leuco dye and a reversible developer, the molten organic low-molecular material prior to crystallization is a color developing mixture of the leuco dye and the reversible developer, and the color tone of the thermoreversible recording medium is changed reversibly between clear state and clouded state by heat.

17. The method for image processing according to claim 14, wherein irradiation of the laser beam to the first image forming area and irradiation of the laser beam to the second image forming area is performed at intervals of 60 seconds or less.

18. The method for image processing according to claim 14, wherein the light irradiation intensity of the center is 1.03 times or less than 1.03 times the light irradiation intensity of the periphery in the light intensity distribution of cross-section in a direction approximately perpendicular to the traveling direction of the laser beam irradiated at least in any one of the image forming step and the image erasing step.

19. An image processing apparatus, comprising:

at least a laser beam irradiation unit; and a laser beam intensity adjusting unit placed on a surface of the laser beam irradiation unit from which a laser beam is irradiated and configured to change the light irradiation intensity of the laser beam, wherein the image processing apparatus is used for the method for image processing, comprising:

at least any one of image forming step and image erasing step, wherein an image is formed on a thermoreversible recording medium in which any one of transparency and color tone is changed reversibly depending on temperatures attained by the medium by heating due to laser beam irradiation to the thermoreversible recording medium in the image forming step, an image formed on the thermoreversible recording medium is erased by heating due to laser beam irradiation to the thermoreversible recording medium in the image erasing step, and a light irradiation intensity of the center is 1.05 times or less than 1.05 times the light irradiation intensity of the periphery in the light intensity distribution of cross-section in a direction approximately perpendicular to the traveling direction of the laser beam irradiated at least in any one of the image forming step and the image erasing step.

20. The image processing apparatus according to claim 19, wherein the light irradiation intensity adjusting unit is at least any one of lens, filter, mask and mirror.

* * * * *